US010577866B2

(12) United States Patent
Kirkhope et al.

(10) Patent No.: US 10,577,866 B2
(45) Date of Patent: Mar. 3, 2020

(54) DRILLING DIRECTION CORRECTION OF A STEERABLE SUBTERRANEAN DRILL IN VIEW OF A DETECTED FORMATION TENDENCY

(71) Applicant: HALLIBURTON ENERGY SERVICES, INC., Houston, TX (US)

(72) Inventors: Kennedy J. Kirkhope, Nisku (CA); Jonathan Peter Zacharko, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 183 days.

(21) Appl. No.: 15/520,043

(22) PCT Filed: Nov. 19, 2014

(86) PCT No.: PCT/US2014/066349
§ 371 (c)(1),
(2) Date: Apr. 18, 2017

(87) PCT Pub. No.: WO2016/080978
PCT Pub. Date: May 26, 2016

(65) Prior Publication Data

US 2017/0314332 A1 Nov. 2, 2017

(51) Int. Cl.
*E21B 7/06* (2006.01)
*E21B 47/022* (2012.01)
(Continued)

(52) U.S. Cl.
CPC ..... *E21B 7/067* (2013.01); *E21B 7/062* (2013.01); *E21B 44/00* (2013.01); *E21B 47/024* (2013.01);
(Continued)

(58) Field of Classification Search
CPC .. E21B 44/00; E21B 47/02232; E21B 47/024; E21B 49/003; E21B 7/06; E21B 7/062; E21B 7/067
See application file for complete search history.

(56) References Cited

U.S. PATENT DOCUMENTS 3,196,959 A 7/1965 Kammerer
3,824,437 A 7/1974 Blaschke
(Continued)

FOREIGN PATENT DOCUMENTS

GB 2172325 9/1986
GB 2230288 10/1990
(Continued)

OTHER PUBLICATIONS

OnePetro, "Downhole Steering Automation and New Survey Measurement Method Significantly Improves High-Dogleg Rotary-Steerable System Performance", http://www.onepetro.org/mslib/app/Preview.do?paperNumber=SPE-166165-MS&societyCode=SPE, 2013, Society of Petroleum Engineers, pp. 2.
(Continued)

*Primary Examiner* — Robert E Fuller
*Assistant Examiner* — Christopher J Sebesta
(74) *Attorney, Agent, or Firm* — Polsineli PC

(57) ABSTRACT

A method for causing a desired drilling direction of a steerable subterranean drill in consideration of a contemporaneously detected formation tendency force acting on a drill bit of the steerable subterranean drill. The method includes detecting, utilizing a steering direction setting device, a direction and magnitude of a formation tendency force acting on the drill bit of the steerable subterranean drill. Further the steering direction setting device is configured to contemporaneously cause the drill bit of the steerable subterranean drill to drill in the desired direction, counteracting
(Continued)

the formation tendency force based on the detected direction and magnitude of the formation tendency force acting on the drill bit.

13 Claims, 19 Drawing Sheets

(51) Int. Cl.
*E21B 44/00* (2006.01)
*E21B 47/024* (2006.01)
*E21B 49/00* (2006.01)

(52) U.S. Cl.
CPC ..... *E21B 47/02232* (2013.01); *E21B 49/003* (2013.01)

(56) References Cited

U.S. PATENT DOCUMENTS 4,299,296 A 11/1981 Geczy
4,324,297 A 4/1982 Denison
4,394,881 A 7/1983 Shirley
4,407,377 A 10/1983 Russell
4,445,578 A 5/1984 Millheim
4,476,943 A 10/1984 Williams
4,491,187 A 1/1985 Russell
4,662,458 A 5/1987 Ho
4,739,841 A 4/1988 Das
4,754,821 A 7/1988 Swietlik
4,821,563 A 4/1989 Maron
4,947,944 A 8/1990 Coltman et al.
4,958,517 A 9/1990 Maron
5,168,941 A 12/1992 Krueger et al.
5,220,963 A 6/1993 Patton
5,265,684 A * 11/1993 Rosenhauch ..... E21B 17/1014 175/61
5,293,945 A 3/1994 Rosenhauch et al.
5,368,110 A 11/1994 French
5,386,724 A * 2/1995 Das ..... E21B 47/0006 175/40
5,421,421 A 6/1995 Appleton
5,467,834 A 11/1995 Hughes et al.
5,547,031 A 8/1996 Warren et al.
5,608,162 A 3/1997 Ho
5,685,379 A 11/1997 Barr et al.
5,720,355 A 2/1998 Lamine et al.
5,931,239 A 8/1999 Schuh
5,945,385 A * 8/1999 Naraghi ..... C09K 8/035 252/1
6,068,394 A 5/2000 Dublin
6,082,457 A 7/2000 Best et al.
6,092,610 A 7/2000 Kosmala et al.
6,158,529 A 12/2000 Dorel
6,227,313 B1 5/2001 Davis et al.
6,233,524 B1 5/2001 Harrell et al.
6,244,361 B1 * 6/2001 Comeau ..... E21B 7/062 175/24
6,321,857 B1 11/2001 Eddison
6,328,119 B1 12/2001 Gills et al.
6,415,878 B1 6/2002 Cargill et al.
6,439,325 B1 * 8/2002 Peters ..... E21B 7/068 175/325.5
6,550,548 B2 4/2003 Taylor
6,769,499 B2 8/2004 Cargill et al.
6,840,336 B2 1/2005 Schaag et al.
7,036,580 B2 5/2006 McGarian et al.
7,147,066 B2 12/2006 Chen et al.
7,216,726 B2 5/2007 Swietlik et al.
7,306,058 B2 12/2007 Cargill et al.
7,306,060 B2 12/2007 Krueger et al.
7,413,032 B2 8/2008 Krueger
7,413,034 B2 8/2008 Kirkhope et al.
7,426,967 B2 9/2008 Sugiura
7,445,060 B2 11/2008 Stroud et al.
7,464,770 B2 12/2008 Jones et al.
7,467,673 B2 12/2008 Earles et al.
7,481,282 B2 1/2009 Horst et al.
7,588,082 B2 9/2009 Lasater
7,637,321 B2 12/2009 Zazovsky et al.
7,685,732 B2 3/2010 Davis et al.
7,703,550 B2 4/2010 Nevlud et al.
7,735,581 B2 6/2010 Beylotte et al.
7,762,356 B2 7/2010 Turner et al.
7,775,099 B2 8/2010 Bogath et al.
7,798,253 B2 9/2010 Schuh
7,950,473 B2 5/2011 Sugiura
7,967,081 B2 6/2011 Sugiura
8,118,114 B2 2/2012 Sugiura
8,191,651 B2 6/2012 Hall et al.
8,286,733 B2 10/2012 Tulloch et al.
8,302,703 B2 11/2012 Rolovic
8,360,172 B2 1/2013 Santelmann
8,453,765 B2 6/2013 Haughom
8,484,858 B2 7/2013 Brannigan et al.
8,534,380 B2 9/2013 Sheppard et al.
2003/0034178 A1 * 2/2003 Cargill ..... E21B 7/062 175/73
2008/0190665 A1 * 8/2008 Earles ..... E21B 7/06 175/24
2009/0044981 A1 2/2009 Sheppard et al.
2009/0205867 A1 * 8/2009 Reckmann ..... E21B 47/024 175/24
2010/0236830 A1 * 9/2010 Haughom ..... E21B 7/062 175/76
2011/0240368 A1 10/2011 Allen et al.
2012/0046865 A1 2/2012 Heisig et al.
2012/0055327 A1 3/2012 Holowczak
2012/0061099 A1 3/2012 Wold et al.
2012/0285746 A1 * 11/2012 Kvalvik ..... E21B 7/06 175/74
2013/0146363 A1 6/2013 Haughom

FOREIGN PATENT DOCUMENTS

GB 2425791 11/2006
WO 9008245 7/1990
WO 12162833 12/2012

OTHER PUBLICATIONS

Kapoh, Oddy, New Locking Clutch Turbine Technology Successfully Frees Stuck Bit/BHA in Deep Gas Wells Oman, 2011.
Warren, Tommy; Slimhole rotary steerable system broadens applications; Sep. 1997.
Weatherford; Revolutionizing drilling efficiency in all types of environments, 2009.
Rotary Steerable System; (http://www.bakerhughes.com/products-and-services/drilling/drill-bit-systems) published on Jan. 11, 2010, pp. 4.
Oil and Gas Journal , "Rotary Steerable System Replaces Slide Mode for Directional Drilling Applications", http://www.ogi.com/articles/print/volume-96/issue-9/in-this-issue/general-interest/rotary-steerable-system-replaces-slide-mode-f.html ; published on Mar. 2, 1998, pp. 3.
Clegg, Barr.; Steerable Rotary Drilling with an Experimental System, https://www.onepetro.org/, 1995, pp. 2.
OnePetro, "Coupling of Downhole Dynamics Recorder Enhance System-Matched Approach to Drill Bit Design and Application with a Specific Rotary Steerable System." http://www.onepetro.org/mslib/servlet/onepetropreview?id=SPE-102182-MS; 2006, pp. 2.
OnePetro, "The First OffShore Use of an Ultra High Speed Drilling Telemetry Network Involving a Full LWD Logging Suite and Rotary Steerable Drilling System", http://www.onepetro.org/mslib/servlet/onepetropreview?id=SPE-110939-MS 11/7/, 2007, pp. 2.
OnePetro, "Integrated Approach to Rotary-Steerable Drilling Optimization using Concurrent Real-Time measurement of Near-bit Borehole Caliper and Near-bit Vibration.", http://www.onepetro.org/mslib/servlet/onepetropreview?id=SPE-112163-MS, 2008, pp. 2.

(56) References Cited

OTHER PUBLICATIONS

Schlumberger; PowerDrive vorteX Powered Rotary Steerable System; http://www.slb.com/services/drilling/directional_drilling/powerdrive_family/powerdrive_vortex.aspx; 2013 Schlumberger Limited and retrieved Nov. 7, 2013, pp. 2.
OnePetro; "Real-Time BHA Bending Information Reduces Risk when Drilling Hard Interbedded BHA Bending Information Reduces Risk when Drilling Hard Interbedded Formations." http://www.onepetro.org/mslib/app/Preview.do?paperNumber=00079918&societyCode=SPE, 2003, pp. 2.
OnePetro, "The Use of the Industry's First 3-D Mechanical Caliper Image While Drilling Leads to Optimized Rotary-Steerable Assemblies in Push- and Point-the-Bit Configurations", http://www.onepetro.org/mslib/app/review.do?paperNumber=SPE-115395-MS&societyCode=SPE, 2008. Society of Petroleum Engineers, pp. 2.
International Search Report and Written Opinion; PCT Application No. PCT/US2014/066349; dated Aug. 10, 2015.

* cited by examiner

DRILLING DIRECTION CORRECTION OF A STEERABLE SUBTERRANEAN DRILL IN VIEW OF A DETECTED FORMATION TENDENCY

CROSS-REFERENCE TO RELATED APPLICATIONS

This application is a national stage entry of PCT/US2014/066349 filed Nov. 19, 2014, said application is expressly incorporated herein in its entirety.

FIELD

The present disclosure relates generally to subterranean drilling systems. More particularly, the present disclosure relates to adjusting drilling steering direction in consideration of formation tendency.

BACKGROUND

During drilling operations, there are numerous forces that act on a drill bit that can influence the drilling direction. For example, a drilling steering tool, such as a rotary steerable tool, may be impacted by lateral forces that tend to "push" steering, via the drill bit, in a particular direction.

Lateral forces include, for example, forces exerted on the drill bit by the formation through which drilling is taking place. During straight drilling, lateral forces can result from such causes as anomalies in the formations being drilled, formation anisotropy, imbalances in the drill string, the arrangement of components within the drill string, and as a reaction to rotation of the drill bit (also referred to colloquially as "bit walk"). During directional drilling, lateral forces may additionally result from reaction forces exerted by the formation in resistance to the steering tool's lateral push to change the direction of drilling. These lateral forces exerted by the formation against the drill bit, and in turn the steering tool, are referred to generally as "formation tendency."

Directional steering of the drill can be carried out in several ways. For example, in a "push the bit" system, the drill bit is pushed laterally in the desired direction. In a "point-the-bit" system, the drill bit is pointed in the desired direction by changing the orientation of the drill bit axis relative the borehole. In both systems, for steering purposes, it is typically assumed that drilling proceeds in the direction the drill bit is pushed or pointed, and that the borehole exerts a reaction force on the steering tool in a direction directly opposite to the direction in which the drill bit is being pushed or pointed.

However, the indeterminate lateral forces noted above push and pull on the drill bit, via the toolface, altering the steering direction and causing drilling to veer off course. Therefore, an operator may intend to drill in one direction toward a target, yet due to these lateral forces, drilling proceeds off course.

BRIEF DESCRIPTION OF THE DRAWINGS

Implementations of the present technology will now be described, by way of example only, with reference to the attached figures, wherein.

DETAILED DESCRIPTION

Figure 1:
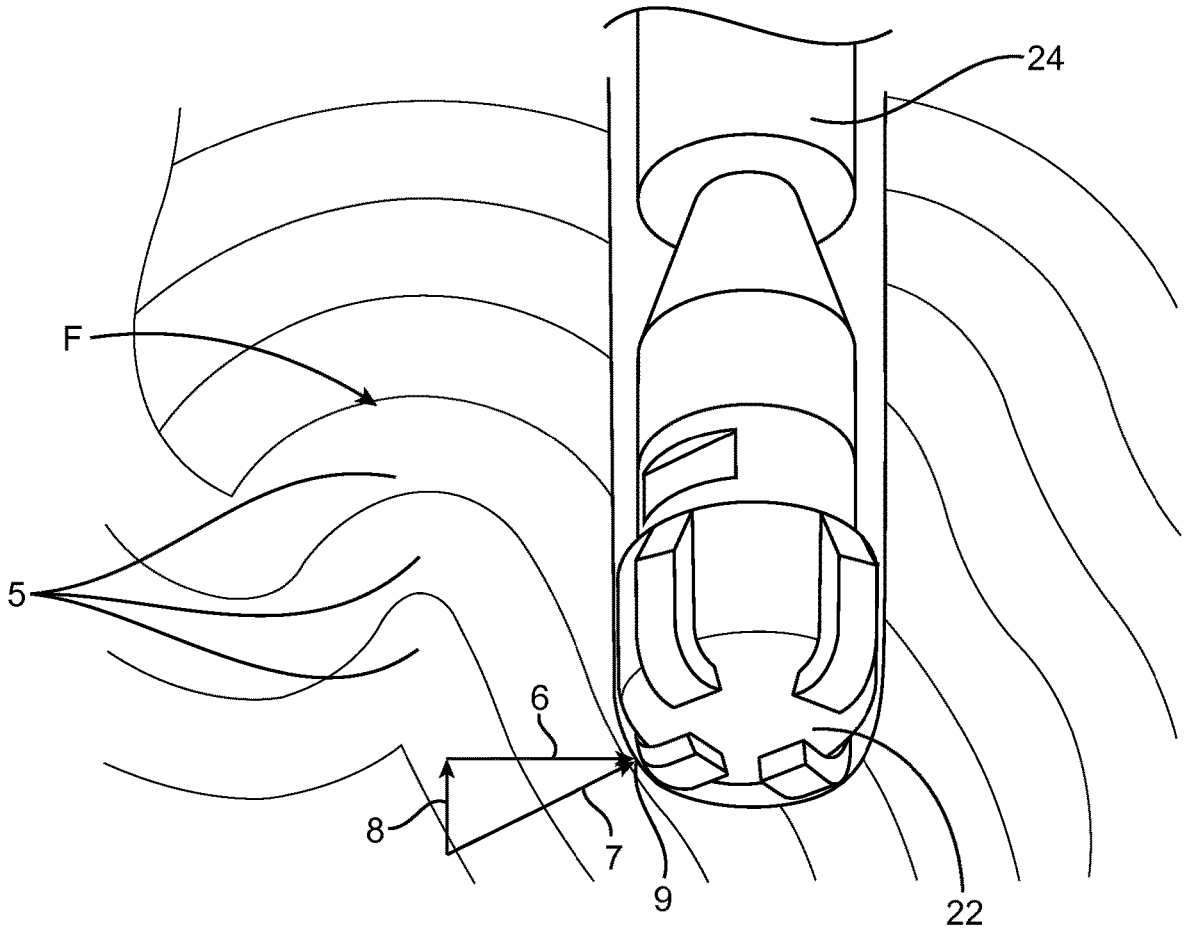
FIG. 1 is a schematic diagram illustrating vectors of the formation tendency.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding borehole even though the borehole or portions of it may be deviated or horizontal. Correspondingly, the transverse, axial, lateral, longitudinal, radial, and the like orientations shall mean positions relative to the orientation of the borehole or tool. Additionally, the illustrated embodiments are depicted so that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "communicatively coupled" is defined as connected, either directly or indirectly through intervening components, and the connections are not necessarily limited to physical connections, but are connections that accommodate the transfer of data between the so-described components. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder.

The term "radial" and/or "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

A system and method are disclosed for correcting a drilling direction of a steerable subterranean drill in consideration of a contemporaneously detected formation tendency force acting on a drill bit. In particular, the direction and magnitude of a formation tendency force acting on the drill bit of the steerable subterranean drill is first detected. The steering direction setting device is then configured to contemporaneously cause the drill bit of the steerable subterranean drill to drill in the desired direction, counteracting the formation tendency force based on the detected direction and magnitude of the formation tendency force acting on the drill bit.

As disclosed herein, the direction and magnitude of the formation tendency may be detected by sweeping a drill bit in a substantially 360 degree orbit. By measuring the peak maximum torque during this sweep, as well as the orientation at which it occurs, the direction and magnitude of the formation tendency can be determined. Additionally the steering direction setting device can include electrically commutated motors (ECM) and eccentric rings to carry out the sweep as well as effect direction. The current supplied to the ECM during the sweep can provide a basis for calculating torque, and consequently, the magnitude of the formation tendency. A controller can then transmit instructions to correct the drilling direction to counteract the effects of formation tendency.

Steering Corrections Based on Forces Acting on a Steering Tool

During drill operations, there are numerous forces that act on a drill bit which can influence the drilling direction, such as formation anisotropy, and various anomalies in the formation. These forces imposed by the formation, referred to herein for convenience as formation tendency, can cause the drilling direction to veer off course from the desired direction. There may be a number of formation forces acting at any one location, but those forces can be resolved into one resultant formation force. The component of the formation force (tendency) that is aligned with the drilling direction imposes little effect on drilling direction, but the transverse component of the resultant formation force can cause drilling direction deviation. Therefore, the forces acting on the drill bit and/or tool face are frequently referred to as lateral force(s). Because of these course-altering formation forces, the drilling operator must repeatedly check-and-correct the drilling direction of the drill bit in an on-going, iterative process. The present disclosure, however, describes a proactive process in which the formation tendency is detected and the drilling direction contemporaneous adjusted to compensate for the formation tendency in order to achieve the desired drilling direction. Contemporaneous herein means a real time response, where drilling direction is substantially immediately or concurrently adjusted, or at approximately the same time so as to correct for the effect of formation tendency on drilling direction.

One example of the effect of lateral forces, such as formation tendency is illustrated in FIG. 1. Shown in FIG. 1 is a drill shaft 24 having drill bit 22, which is drilling down within a formation F. The formation F is made up of a plurality of layers 5 stacked upon one another and extending in varying directions. The formation layers 5 can be the same or different type of rock but will differ by some property or characteristic which differentiates one layer from another. When drilling, the shape and slope of each of the layers can affect the direction of drilling. The change in direction imposed on the drilling direction by the shape of these layers can be referred to as formation tendency discussed above. As shown in FIG. 1, the drill bit 22 begins to drill into the surface 9 of a new layer of rock in formation F. The formation layer imposes a force on the drill bit with a magnitude and direction (i.e., vector) illustrated by the respective vector arrows in FIG. 1. The layer imposes a side force illustrated by vector 6, as well as a vertical force illustrated by vector 8 on the drill bit 22. From these, a formation tendency normal force illustrated by vector 7 is imposed on the drill bit 22 as shown in FIG. 1.

Figure 2A:
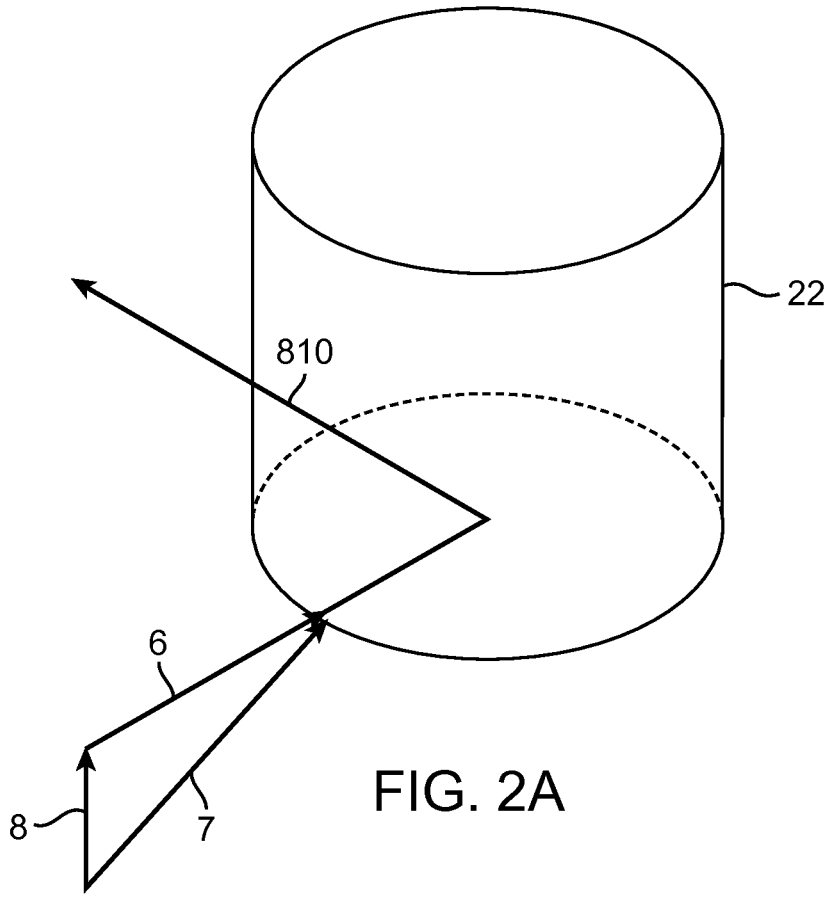
FIG. 2A is a schematic diagram illustrating vectors of the formation tendency and a desired drilling direction.
Figure 2B:
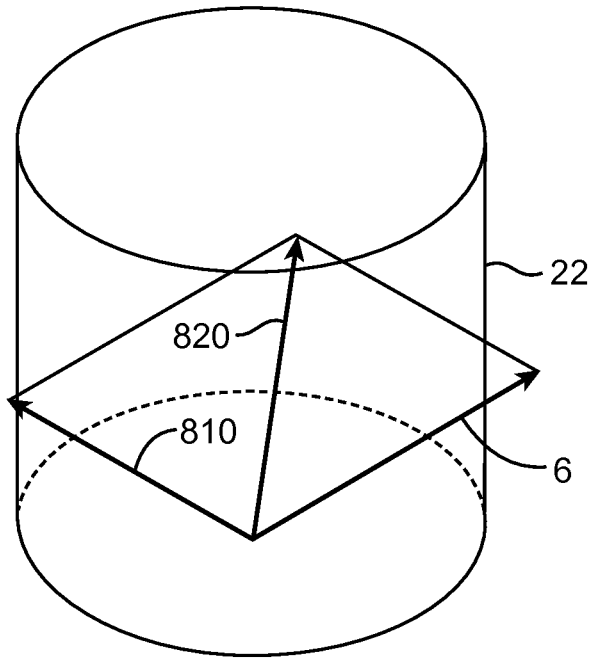
FIG. 2B is a schematic diagram illustrating vectors of the formation tendency and an actual drilling direction.
Figure 2C:
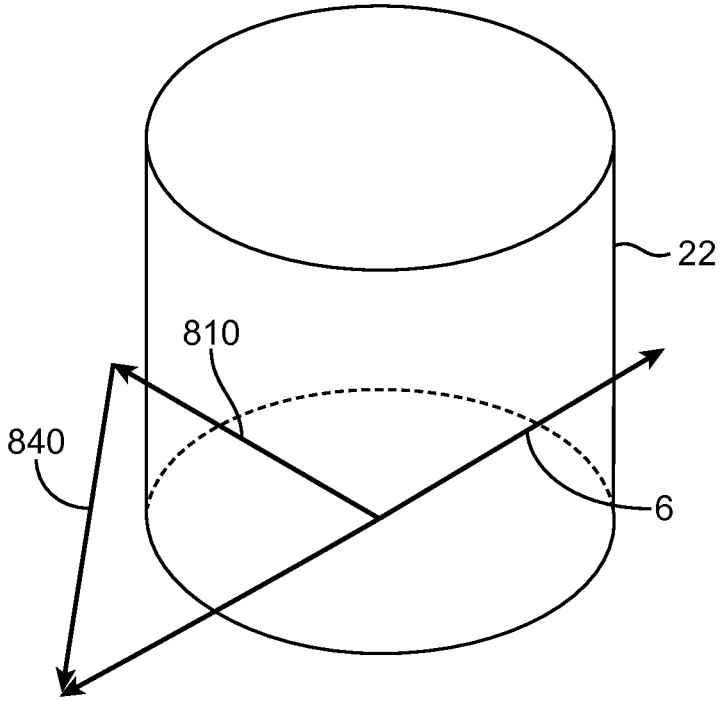
FIG. 2C is a schematic diagram illustrating vectors of the formation tendency and a corrected drilling direction.

The same vertical force vector 8, side force vector 6, and formation tendency normal force vector 7 are shown also in FIG. 2A (vectors, i.e., direction and magnitude of a forces, are represented by the arrows in FIGS. 2A-2C). The forces are shown in an isometric view of drill shaft 24 and drill bit 22. The desired drilling direction vector 810 shown by the arrow pointing to the upper left of the figure indicates the desired drilling direction. Due to the formation tendency normal force represented by vector 7 on the drill bit 22, the drilling direction is shifted off course from desired drilling direction represented by vector 810. In particular, as shown in FIG. 2B, the side force represented by vector 6 shifts drilling from the desired direction shown by vector 810 to the actual drilling direction represented by vector 820. In this way the direction of drilling is shifted off course. However, as described herein, by applying vector addition, a corrective force can be applied to counteract the force imposed by the formation tendency. In particular, by vector addition, in view of the side force vector 6 and the desired drilling direction vector 810, the corrected drilling direction vector 840 can be determined, represented by the arrow pointing downward and to the left in FIG. 2C. Accordingly, by drilling in this corrected direction, the formation tendency can be counteracted and drilling in the desired direction 810 can be achieved.

Figure 3:
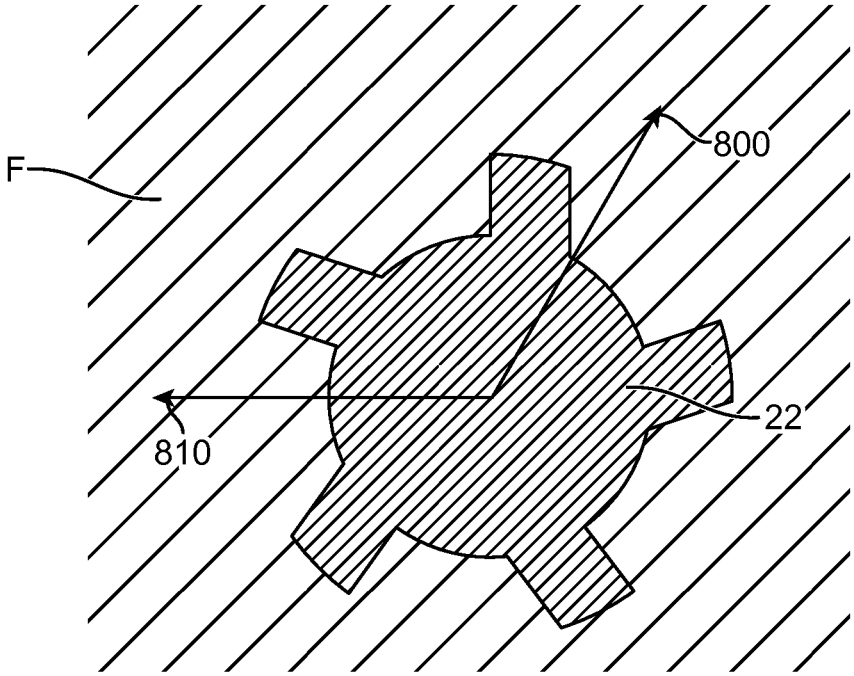
FIG. 3 is a schematic diagram illustrating vectors of the formation tendency and a desired drilling direction.
Figure 4:
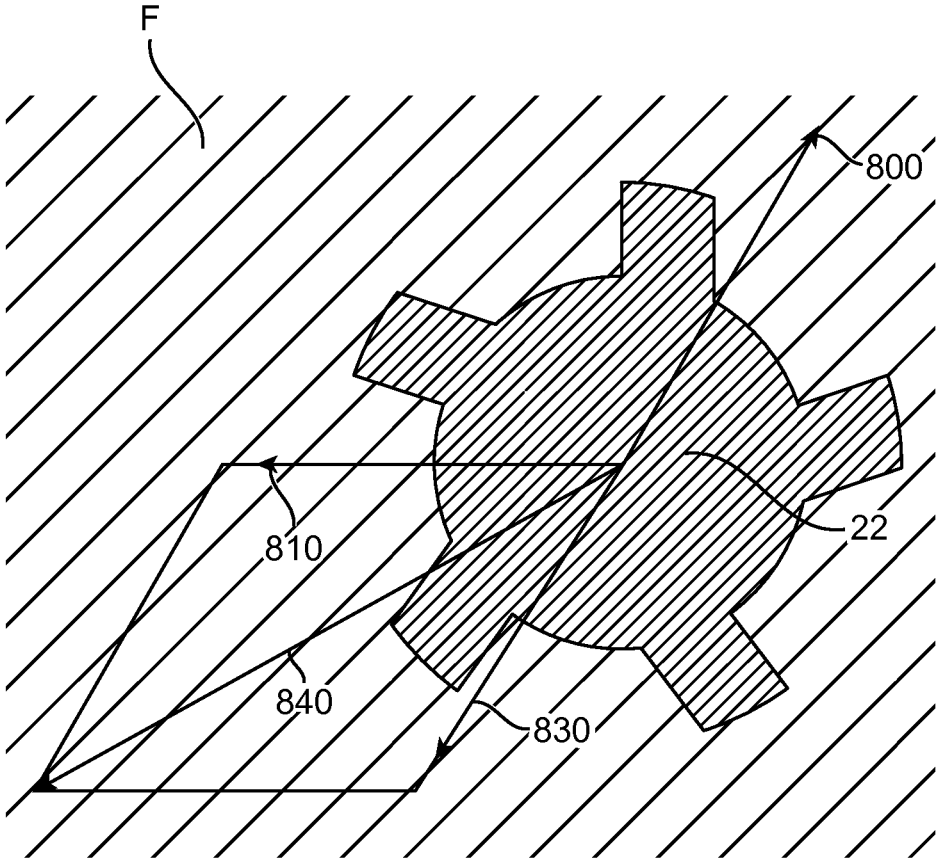
FIG. 4 is an exemplary sectional view demonstrating a simplified vector calculation for correcting drilling direction.

An additional schematic discussion is illustrated in FIGS. 3-4, showing a sectional view of formation F and a drilling bit 22. Illustrated in FIG. 3 is a vector arrow 800 pointing to the upper right of the figure which represents the direction and magnitude of the force of the formation tendency. The vector 810 pointing to the left side of the figure represents the desired drilling direction and magnitude. The magnitude of the desired direction can be referred to for example as the side cutting force—due to the drill bit cutting, or being forced, diagonally into the formation as it drills. Such value can be measured by a force sensor, and/or by the MWD system previously noted. Alternatively, or additionally, this can be determined with reference to the amount of pressure applied at the surface upon the drill string in the borehole. Depending on the magnitude and direction of the formation tendency, the actual drilling direction will proceed somewhere between the desired drilling direction and the direction of the formation tendency.

With knowledge of the magnitude and direction at which the formation is exerting force, the desired drilling direction can be instituted. For example, by employing simple vector mathematics, the force of the formation tendency can be accounted for, and the desired drilling direction achieved. For example, FIG. 4 demonstrates a simple vector addition. The formation tendency is shown by the vector arrow 800 pointing to the upper right, whereas the desired drilling direction is shown by the vector 810 pointing to the left similar to FIG. 3. By noting a counteracting force (equal, but opposite) 830 to the formation force, along with the desired drilling direction and magnitude of vector 810, a resulting vector 840 can be determined. This resultant vector 840 represents the force and direction at which the toolface must act on the formation during drilling in order to overcome the formation tendency and drill in the desired direction.

The magnitude and direction of the formation tendency is determined empirically, and can differ greatly between sites and along a formation borehole. Disclosed herein are multiple examples for measuring or determining the formation tendency.

In some examples, the direction and magnitude of the formation tendency can be determined by using a rotary steerable drilling device. For example, referring to FIG. 5, the formation tendency is determined by rotating a deflected drilling shaft 24 through a substantially 360 degree sweep during which the toolface of the drill bit 22 is pressed against the circumferential periphery of the borehole wall. In the absence of any lateral force, such as formation tendency, the force required to rotate the toolface in one complete revolution will be constant throughout the sweep. However, if the formation imposes a lateral force, the portion of the sweep which acts opposite the formation tendency will require the greatest, or maximum, torque. By measuring this peak maximum torque, as well as the orientation of the drilling shaft 24 or drill bit 22 at which it occurred, the lateral force applied by the formation as well as its direction can be determined. Accordingly, both (1) the magnitude of the maximum torque and (2) the orientation at which maximum torque occurred is determined. Based on this measurement, steering corrections can be made as in FIG. 4 in order to drill in the desired direction.

The shaft deflection device of a rotary steerable drilling device disclosed herein, and discussed in detail in FIGS. 6A and 6B below, can be used to determine formation tendency. In particular, the torque provided by the drive motors of the shaft deflection device for rotation of the shaft in the rotary steerable drilling device can be used to determine formation tendency. Further, the torque is determinable based on built in features of an electrically commutated motor (ECM) as part of the drive motors.

Rotary Steering Device Having a Drilling Shaft Deflection Device

Figure 6A:
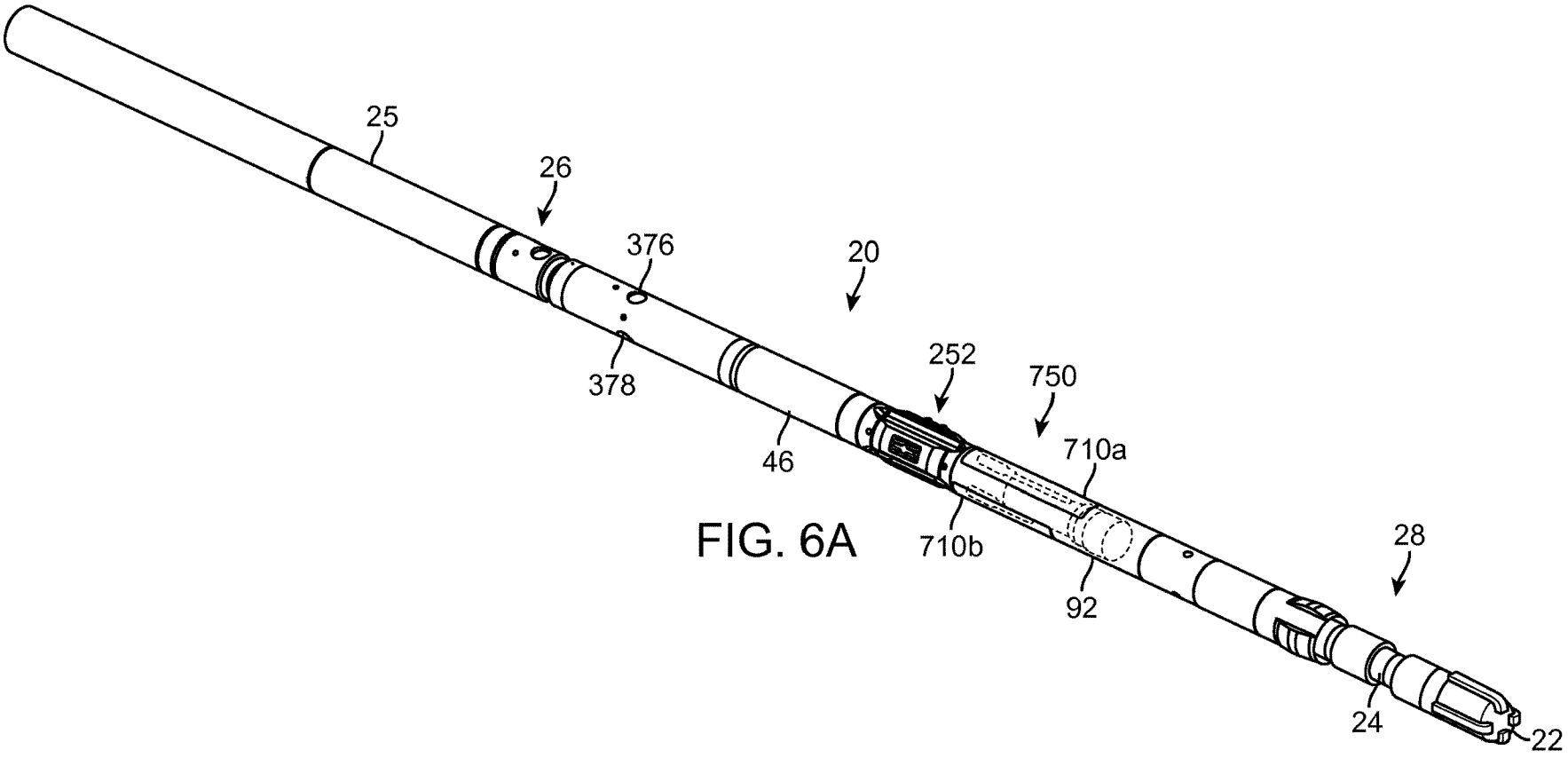
FIG. 6A is a diagram illustrating an embodiment of a rotary steerable drilling device.
Figure 6B:
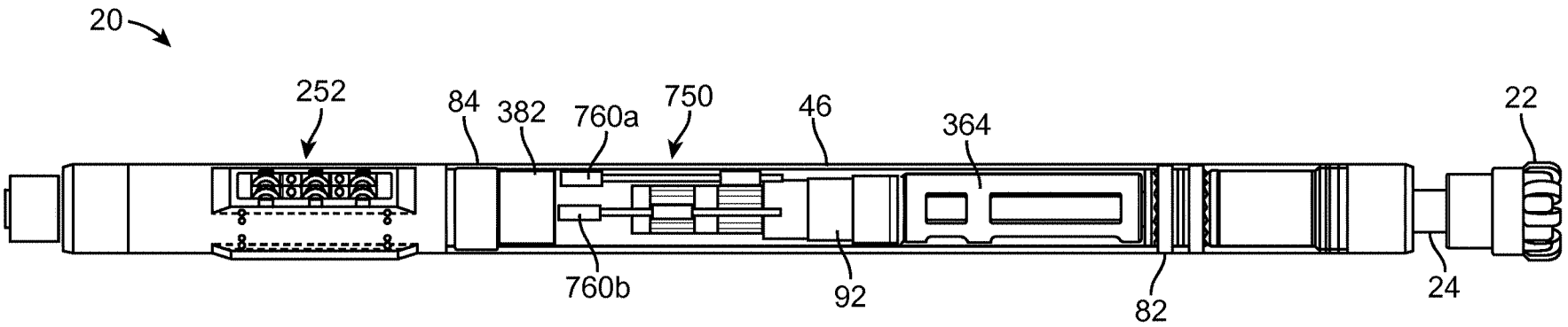
FIG. 6B is a diagram illustrating an embodiment of a rotary steerable drilling device.

As shown in FIGS. 6A and 6B, the rotary steerable drilling device 20 includes a rotatable drilling shaft 24 which is connectable or attachable to a rotary drilling bit 22 and to a rotary drilling string 25 during the drilling operation. More particularly, the drilling shaft 24 has a proximal end 26 typically closest to the earth's surface via the wellbore 48 (shown in FIG. 20) and a distal end 28 deepest in the well, typically furthest from the earth's surface via the wellbore 48.

The distal end 28 of the drilling shaft 24 is drivingly connectable or attachable with the rotary drilling bit 22 such that rotation of the drilling shaft 24 by the drilling string 25 results in a corresponding rotation of the drilling bit 22.

The rotary steerable drilling device 20 includes a housing 46 for rotatably supporting a length of the drilling shaft 24 for rotation therein upon rotation of the attached drilling string 25. The housing 46 may support, and extend along any length of the drilling shaft 24. However, in the illustrated example, the housing 46 supports substantially the entire length of the drilling shaft 24 and extends substantially between the proximal and distal ends 26, 28 of the drilling shaft 24.

Figure 5:
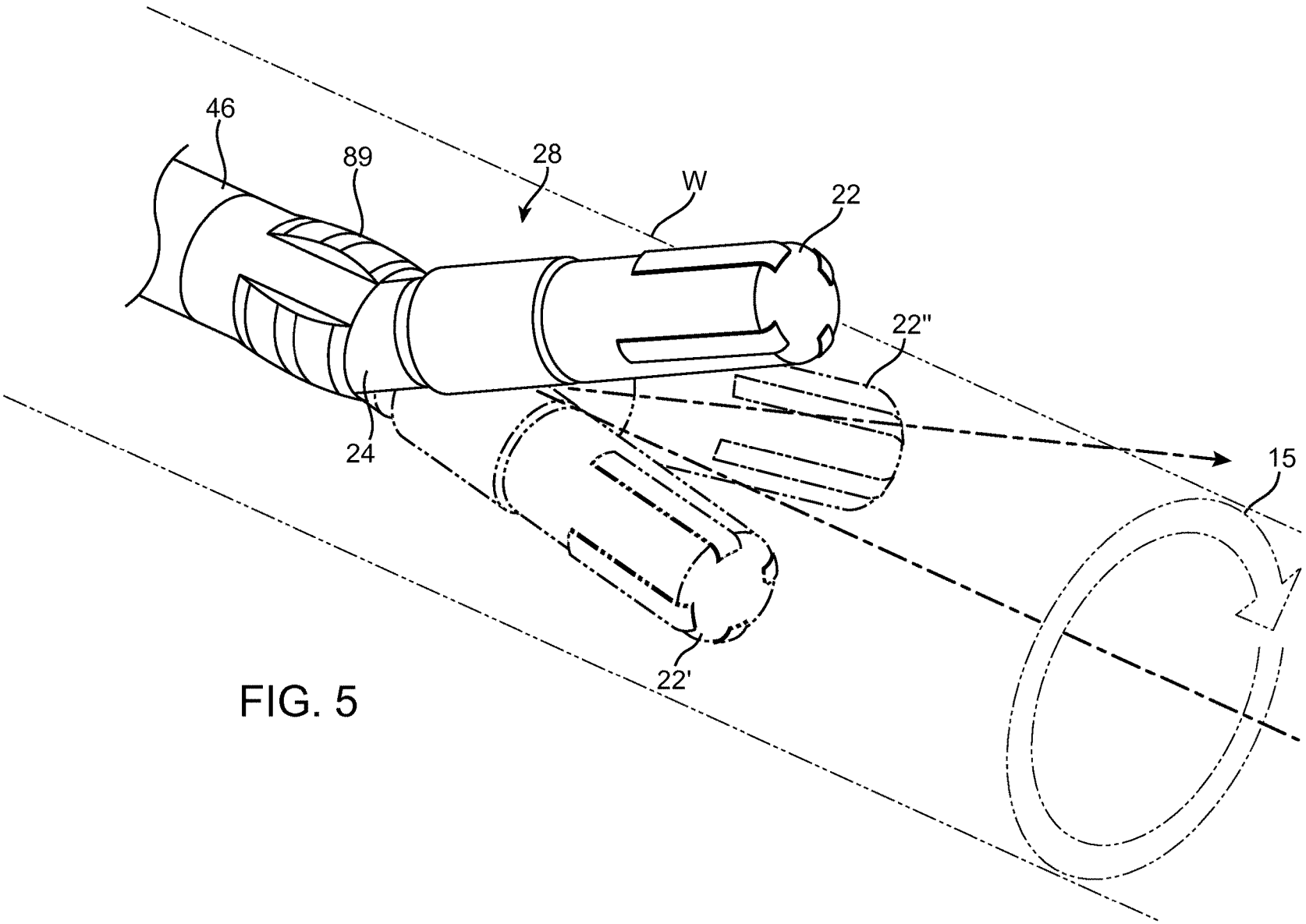
FIG. 5 is a diagram illustrating one example of a 360 degree sweep by the toolface of a drill bit.

An exemplary drilling shaft deflection device 750 is provided in order to deflect the shaft to the desired deflection (bend), obtain the desired azimuthal orientation, as well as sweep the drill bit 22 as shown in FIG. 5. One or more motors (two are shown) including for example an outer eccentric ring drive motor 760*a* and an inner eccentric ring drive motor 760*b* received beneath the hatches 710*a*, 710*b* are. The hatches 710*a*, 710*b* can be secured to the housing 46 with threaded bolts or similar releasable securement mechanisms that facilitate the hatches' 710*a*, 710*b* removal. A seal can also be provided between the hatches 710*a*, 710*b* and the housing 46 which maintains a fluid tight, closed compartment within the housing 46.

Figure 9:
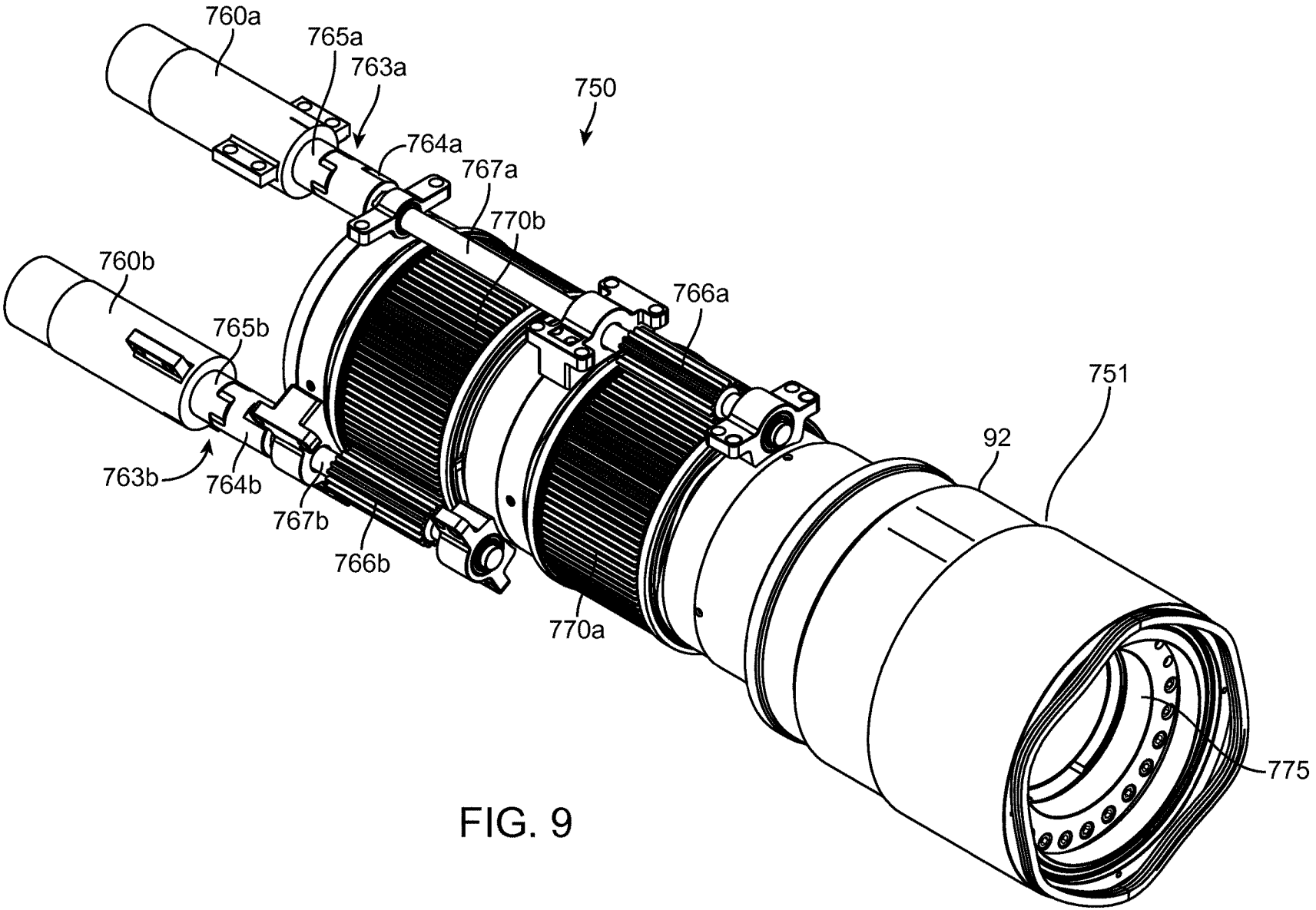
FIG. 9 is a schematic diagram illustrating an embodiment of an internal portion of a drilling shaft deflection device having a pair of drive motors.
Figure 10:
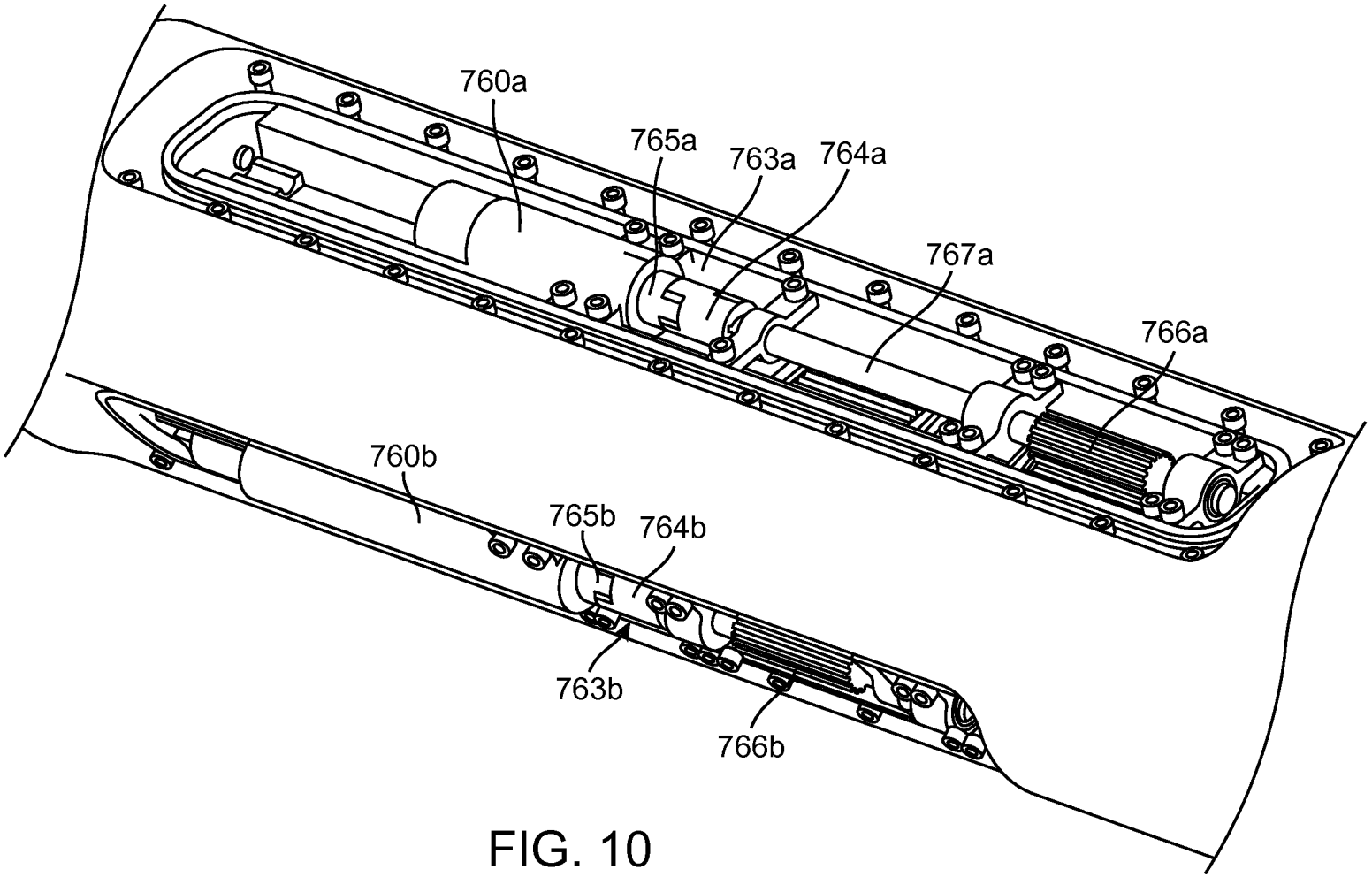
FIG. 10 is a schematic diagram illustrating a portion of a rotary steerable drilling device with hatch covers removed and the pair of drive motors and transmissions exposed.

The outer eccentric ring drive motor 760*a* and an inner eccentric ring drive motor 760*b* are coupled indirectly to the deflection assembly 92 via fixed-ratio transmissions (illustrated in FIGS. 9-10). The deflection assembly 92 provides for the controlled deflection of the drilling shaft 24 resulting in a bend or curvature of the drilling shaft 24 in order to provide the desired deflection of the attached drilling bit 22. The orientation of the deflection of the drilling shaft 24 may be altered in order to change the orientation of the drilling bit 22 or toolface, while the magnitude of the deflection of the drilling shaft 24 may also be altered to vary the magnitude of the deflection of the drilling bit 22 or the bit tilt relative to the housing 46. As described below the deflection assembly can include eccentric rings.

The outer eccentric ring drive motor 760*a* and an inner eccentric ring drive motor 760*b* may be ECMs. As discussed in more detail below, the use of built in features and commutative information of ECMs, along with the fixed ratio coupling to the deflection assembly 92, permits determination of the relative orientation of the deflection of the drilling shaft effected by the deflection assembly 92 as well as the torque required for rotation.

During drilling, the rotary steerable drilling device 20 is anchored against rotation in the wellbore by anti-rotation device 252 or any mechanism, structure, device or method capable of restraining or inhibiting the tendency of the housing 46 to rotate upon rotary drilling may be used. Advantageously, wheels resembling round pizza cutters can be employed that extend at least partially outside the rotary steerable drilling device 20 and project into the earth surrounding the borehole.

The distal end includes a distal radial bearing 82 which included a fulcrum bearing, also referred to as a focal bearing, or some other bearing which facilitates the bending of the drilling shaft 24 at the distal radial bearing location upon the controlled deflection of the drilling shaft 24 by the rotary steerable drilling device 20 to produce a bending or curvature of the drilling shaft 24.

The rotary steerable drilling device 20 has at least one proximal radial bearing 84 which is contained within the housing 46 for rotatably supporting the drilling shaft 24 radially.

The housing orientation sensor apparatus 364 can contain an ABI or At-Bit-Inclination insert associated with the housing 46. Additionally, the rotary steerable drilling device 20 can have a drilling string orientation sensor apparatus 376. Sensors which can be employed to determine orientation include for example magnetometers and accelerometers. The rotary steerable drilling device 20 also optionally has a releasable drilling-shaft-to-housing locking assembly 382 which can be used to selectively lock the drilling shaft 24 and housing 46 together.

Further, in order that information or data may be communicated along the drilling string 25 from or to downhole locations, the rotary steerable drilling device 20 can include a drilling string communication system 378.

Deflection Mechanism

Figure 7:
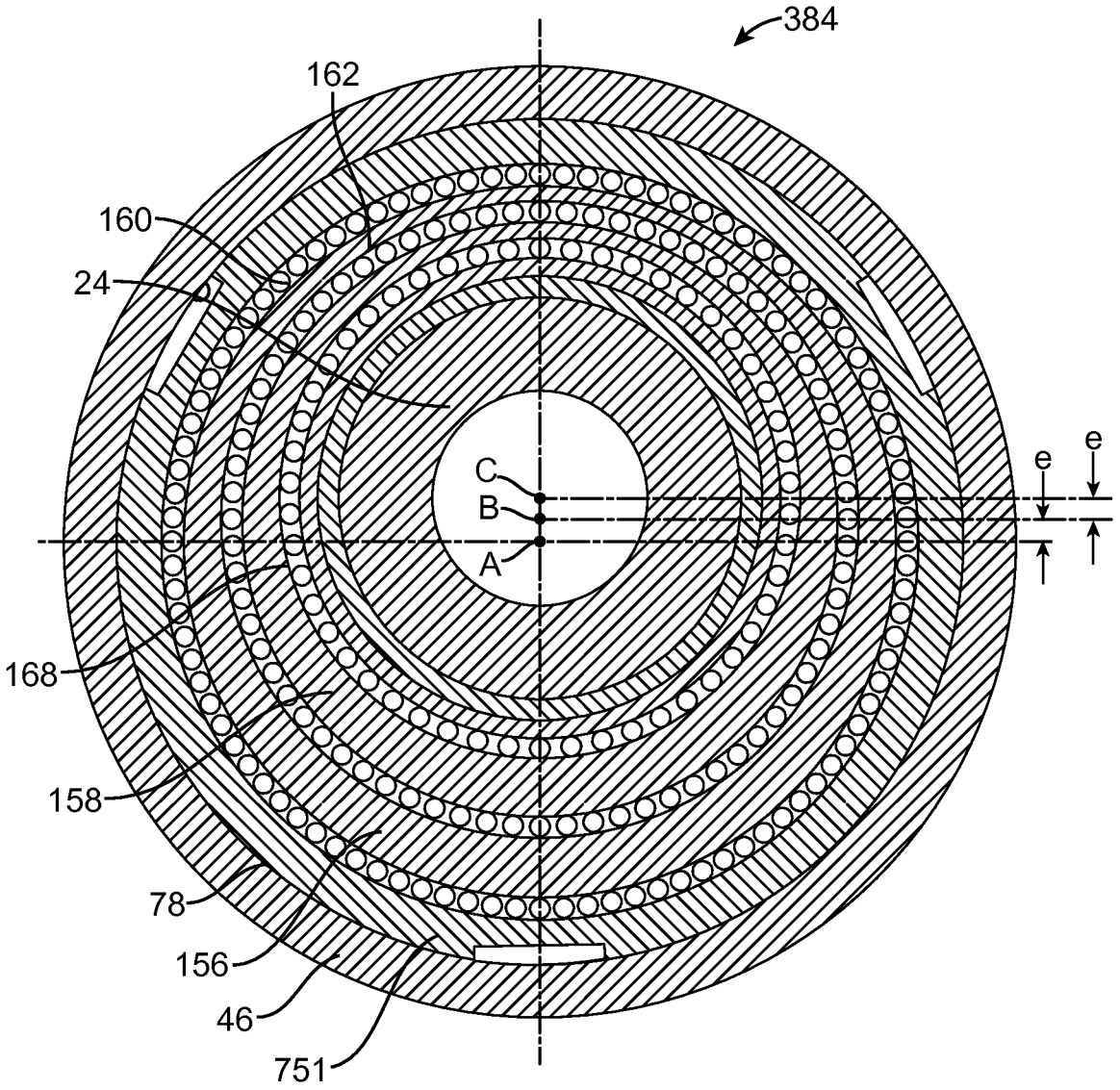
FIG. 7 is a diagram illustrating a drilling shaft deflection assembly, including a rotatable outer eccentric ring and a rotatable inner eccentric ring.

The drive motors 760*a*, 760*b* noted above are connected indirectly to the deflection assembly 92 by fixed-ratio transmissions 780, or transmission components for deflection of the drilling shaft 24. As shown in the exemplary embodiment illustrated in FIG. 7, the deflection assembly 92 has a deflection mechanism 384 made up of a double ring eccentric mechanism. The eccentric rings may be located at a spaced apart distance from one another along the length of the drilling shaft 24. However, in the illustrated example, the deflection mechanism 384 is made up of an eccentric outer ring 156 and an eccentric inner ring 158, provided one within the other at the same axial location or position along the drilling shaft 24, within the housing 46. Rotation of one or both of the two eccentric rings 156, 158 imparts a controlled deflection of the drilling shaft 24 at the location of the deflection mechanism 384.

The eccentric rings contain a drilling shaft receiver 27 which receives and is coupled about the drilling shaft 24 passing therethrough. The central axis of the drilling shaft 24 and the drilling shaft receiver 27 substantially coincide. The outer ring 156, and also the circular outer peripheral surface 160 of the outer ring 156, may be rotatably supported by or rotatably mounted on, directly or indirectly, the circular inner peripheral surface 78 of the housing 46. When indirectly supported, there can be included for example an intermediate housing 751 between the outer ring 156 and inner peripheral surface 78 of the housing 46.

The circular inner peripheral surface 78 of the housing 46 is centered on the center of the drilling shaft 24, or the rotational axis "A" of the drilling shaft 24, when the drilling shaft 24 is in an undeflected condition or the deflection assembly 92 is inoperative. The circular inner peripheral surface 162 of the outer ring 156 is centered on point "B" which is offset from the centerlines of the drilling shaft 24 and housing 46 by a distance "e."

The circular inner peripheral surface 168 of the inner ring 158 is centered on point "C", which is deviated from the center "B" of the circular inner peripheral surface 162 of the outer ring 156 by the same distance "e". As described, the degree of deviation of the circular inner peripheral surface 162 of the outer ring 156 from the housing 46, defined by distance "e", is substantially equal to the degree of deviation of the circular inner peripheral surface 168 of the inner ring 158 from the circular inner peripheral surface 162 of the outer ring 156, also defined by distance "e".

Upon the rotation of the inner and outer rings 158, 156, either independently or together, the center of the drilling shaft 24 may be moved with the center of the circular inner peripheral surface 168 of the inner ring 158 and positioned at any point within a circle having a radius equal to the sum of the amounts of deviation of the circular inner peripheral surface 168 of the inner ring 158 and the circular inner peripheral surface 162 of the outer ring 156.

In other words, by rotating the inner and outer rings 158, 156 relative to each other, the center of the circular inner peripheral surface 168 of the inner ring 158 can be moved to any position within a circle having the predetermined or predefined radius as described above. Thus, the portion or section of the drilling shaft 24 extending through and supported by the circular inner peripheral surface 168 of the inner ring 158 can be deflected by an amount in any direction perpendicular to the rotational axis of the drilling shaft 24.

Figure 8:
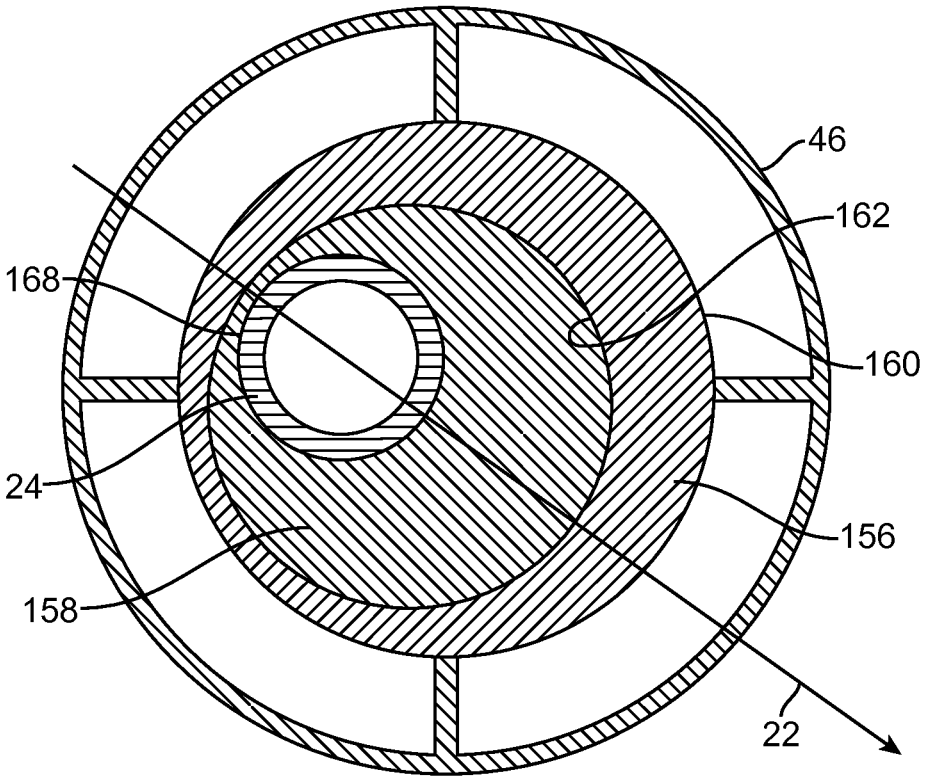
FIG. 8 is a diagram illustrating an embodiment of a deflection assembly of the drilling shaft deflection assembly that exaggerates the offset position of the drilling shaft relative the housing.

A simplified and exaggerated expression of the drilling shaft 24 deflection concept is illustrated in FIG. 8. As depicted, the orientation of the rings 156, 158 causes deflection of the drilling shaft 24 in one direction thereby tilting the drilling bit 22 in the opposite direction relative to the centerline of the deflector housing 46.

In practice, a control signal is sent to one or both motors 760*a*, 760*b* which then actuates and applies a rotating force through one or both spider couplings 763*a*, 763*b* to drive the shafts 765*a*, 765*b* that rotate their respective pinions 766*a*, 766*b*. The pinions 766*a*, 766*b* engage and rotate their respective spur gears 770*a*, 770*b*, which communicate rotation to the respective eccentric rings 156, 158. In this way, the eccentric rings can be singly, or simultaneously rotated from a position in which the axial centers are aligned (i.e., "e" minus "e" equals zero) to any other desired position within a circle having a radius of "2e" around the centerline A of the housing 46. In this way the drilling shaft 24 is deflected at a desired angle. That is, the amount of deflection is affected based on how far the drilling shaft 24 is radially displaced (pulled) away from the centerline of the housing 46. The degree of radial displacement can be affected by rotation of one or both of the eccentric rings 156, 158, in either direction.

Subsequent deflection of the shaft, by rotating the eccentric rings simultaneously, the toolface can be swept in a 360 degree orbit as shown in FIG. 5. The torque provided by the drive motors for the sweep can be used to determine the peak torque during the sweep as well as the orientation at which it occurred, in part due to fixed-ratio transmission between the motors 760*a*, 760*b* and the eccentric rings 156, 158.

Deflection Mechanism

As shown in FIGS. 9-10, the drive motors 760*a*, 760*b* are connected to the eccentric rings by fixed-ratio transmissions 780, or transmission components. These are fixed in their gear ratios such that upon rotation of a rotor within motors 760*a*, 760*b* the fixed-ratio transmissions 780 transmit the rotor's rotation to the mechanical actuator at a particular ratio. The transmissions include for example, spider couplings, shafts, pinions, spur gears further outlined and defined hereinbelow. In particular, the drive motors 760*a*, 760*b* are each coupled to a pinion 766*a*, 766*b* via upper spider coupling 763*a* and lower spider coupling 763*b*. The spider couplings 763*a*, 763*b* are each comprised of opposing interlocking teeth 762*a*, 762*b* which communicate rotation from the drive motors 760*a*, 760*b* to a set of pinions 766*a*, 766*b*. The upper coupling portion 765*a*, 765*b* of each spider coupling 763*a*, 763*b* includes a series of teeth and channels that engage a similar (mirror image) series of teeth and channels on the lower coupling portion 764*a*, 764*b* of each spider coupling 763*a*, 763*b*. There can be drive shafts 767*a*, 767*b* which extend from the lower coupling portion 764*a*, 764*b* to an outer eccentric ring pinion 766*a* and inner eccentric ring pinion 766*b*. The respective pinions 766*a*, 766*b* are each splined, having gear teeth that engage with an outer eccentric ring spur gear 770*a* and inner eccentric ring spur gear 770*b*. The spur gears 770*a*, 770*b* are each splined, having gear teeth that surround the entire peripheral edge of the respective gear and receive the teeth from pinions 766*a*, 766*b*. The spur gears 770*a*, 770*b* can have substantially the same diameter, with a circumference less than that of the housing 46, and alternatively may also have the same or greater than the outer eccentric ring 156.

The pinions 766*a*, 766*b* are positioned adjacent the spur gears 770*a*, 770*b*, at their periphery, so that pinion teeth intermesh with spur gear teeth as shown in FIG. 9. The motors 760*a*, 760*b* provide rotational driving force that is communicated through the spider coupling 763*a*, 763*b* and drive shafts 767*a*, 767*b* causing rotation of the pinions 766*a*, 766*b*. The rotating pinions 766*a*, 766*b* engage and rotate the spur gears 770*a*, 770*b*. The spur gears 770*a*, 770*b* can be connected directly or indirectly to the outer and inner eccentric rings 156, 158 contained within the body of the deflection device 750. For example, spur gears 770*a*, 770*b* can be bolted to inner and outer eccentric rings 156, 158. In the illustrated example, the outer eccentric ring spur gear 770*a* is coupled to the outer eccentric ring 156 via a linkage, which may take the form or an interconnected cylindrical sleeve. The inner eccentric spur gear 770*b*, however, is coupled to the inner eccentric ring 158 via an Oldham coupling. The Oldham coupling permits off-center rotation and the necessary orbital motion of the inner eccentric ring 158 relative the housing 46.

The inner eccentric ring spur gear 770*b* permits deflection or floating of the drilling shaft 24 held in the interior aperture of the inner eccentric ring 156. As the drilling shaft 24 orbits about within the housing 46 as the orientations of the eccentric rings change, the powering transmission, at least to the inner eccentric ring 156, must shift in order to maintain connection to the ring 156, and this is accomplished by use of the Oldham coupling.

Therefore, the fixed-ratio transmissions 780 between the drive motors 760*a*, 760*b* and the eccentric rings 156,158 enable rotation of the rings relative one another to deflect the shaft as well as simultaneous rotation to sweep the toolface.

Electrically Commutated Motors

As discussed above, the drive motors 760*a*, 760*b* are connected to the deflection assembly 92 via fixed-ratio transmissions 780. Each of the drive motors 760*a*, 760*b* employ one or more electrically commutated motors (ECM). The term ECM can include all variants of the general class of electrically commutated motors, which may be described using various terminology such as a BLDC motor, a permanent magnet synchronous motor (PMSM), an electrically commutated motor (ECM/EC), an interior permanent magnet (IPM) motor, a stepper motor, an AC induction motor, and other similar electric motors which are powered by the application of a varying power signal, including motors controlled by a motor controller that induces movement between the rotor and the stator of the motor.

As discussed with respect to FIG. 5, to determine formation tendency both (1) the magnitude of the maximum torque and (2) the orientation at which maximum torque occurred is determined during a sweep of the toolface. The ECMS's as described herein permit determination of these values.

For example, a beneficial aspect of the ECMs employed in the described deflection device 750 is that the degree of deflection of the drilling shaft and the toolface direction of the drill bit can be determined with reference to the position of the ECM's rotor(s). Such positional information can be used to determine the direction of the formation tendency.

Figure 11:
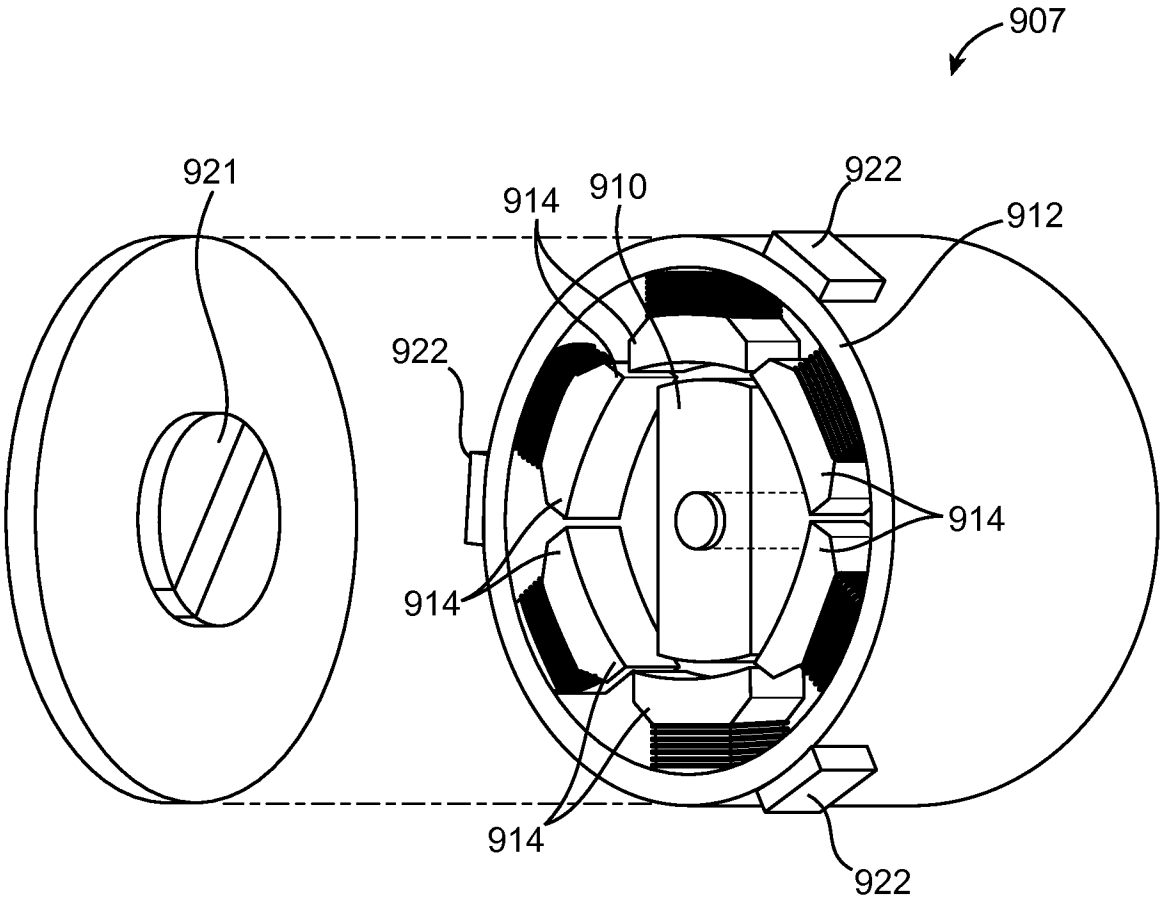
FIG. 11 is a schematic diagram illustrating an embodiment of a simplified electrically commutated motor.

A simplified version of component parts of an ECM 907 is shown in FIG. 11. Illustrated therein is a rotor 910 made up of a magnet and a stator 912 made up of a series of coiled stator pieces 914 surrounding the rotor 910. The relative position of the rotor 910 is used by a motor controller 955 for electric commutation of the rotor 910. A resolver 921 may be used to determine this rotor position, and in particular the degrees of rotation. Alternatively, or in addition to the resolver 921, Hall effect sensors 922 can be employed to detect the position of the rotor 910. In some examples, only one Hall effect sensor need be used, while in other examples a number of Hall effect sensors can be used making up one Hall effect sensor unit, or such Hall effect sensors can be used with a resolver. In still other examples, sensors can be omitted altogether, for instance by employing sensorless commutation techniques used in ECM applications. Sensorless commutation techniques "field oriented control" ("FOC") or "vector mode control." FOC is a control feature performed by the motor controller or other processing device for commutation of the motor. With the sensorless or built-in sensing function of the ECM for electric commutation of the rotor 910, this same information can be employed for determining actuation position of the eccentric rings of the deflection assembly 92.

In particular, the information obtained by the resolver 921 of the ECM 907 or other position sensors can be used by the motor controller 955 to determine and control the mechanical actuator 384 position. This is possible due to fixed gear ratios of the fixed-ratio transmissions 780 between the ECM 907 and the mechanical actuator 384. The motor controller 955 can actuate fixed-ratio transmissions 780, for example, components that convey motive power to the eccentric rings 156, 158, and can include the aforementioned spider couplings 763*a*, 763*b*, pinions 766*a*, 766*b*, or spur gears 770*a*, 770*b*, or other transmission components coupled to the mechanical actuator 384 for deflecting or indexing the shaft 24.

For control of the eccentric rings 156, 158, a sensor, such as a resolver 921, can measure the cumulated number of rotor 910 rotations and position in the ECM 907 required for one full rotation of the eccentric ring 156, 158. The sensor can be built into the ECM, and can be inside or outside the housing of the ECM. Whereas typically a sensor need only detect one rotation of the rotor of the ECM to carry out ordinary commutation, in the present example, the cumulated rotations of the rotor required to rotate the eccentric ring or other mechanical actuator are detected and received at the motor controller. Generally the ECM will require multiple rotor revolutions to turn the eccentric ring one full rotation, by means of the resolver or other sensor, the motor controller tracks the position and number of rotations throughout the life of the ECM relative the corresponding rotation of the eccentric rings.

Accordingly, the motor controller 955 of the ECM 907 uses the commutation information obtained from the resolver 921 to track the corresponding incremental changes to the position of the eccentric ring. This is possible due to the fixed ratio transmissions 780 between the ECM's rotor and eccentric rings 156, 158. Unlike other biasing mechanisms such as clutch systems, the transmissions herein have no slip between each linkage because the system employs fixed gears; namely, reciprocally engaged teeth or splines between gears. Accordingly, there is a fixed gear ratio between each of the transmission components, for example from the ECM rotor to the spider couplings 763*a*, 763*b*, and from there to the pinions 766*a*, 766*b*, and subsequently to the spur gears 770*a*, 770*b*, and finally the eccentric rings 156, 158. Therefore, for every full or partial rotation, or multiple rotations of the ECM rotor 910, there is a direct and fixed amount of rotation of the associated eccentric ring. Accordingly, the resolver 921 provides position information of the ECM rotor 910 as a part of the commutation process, which in turn can be used to control the rotational position of the eccentric ring.

In some examples, in place of a resolver, a Hall effect sensor or sensors 922 can be employed, built-in or proximate the ECM 907. The Hall effect sensors 922 provide positional information of the ECM rotor 910 similar to the resolver 921. The exact placement of the Hall effect sensors or resolver can depend on the sensitivity or the particular build of the ECM. Alternatively, sensors can be dispensed with altogether by use of the energized phase of the motor to infer where the rotor is in its rotation. In other examples, the motor can employ FOC or "vector mode control."

Another beneficial aspect of the ECMs employed herewith is that the magnitude of the formation tendency can be obtained indirectly by measuring the torque delivered by the ECM. In particular, ECMs have a built-in feedback control feature which determines or calculates the amount of torque produced by the motor. This built-in feature in the ECMs allows for the overall reduction in the need for additional sensors or processing units elsewhere in the rotary steerable drill, as this function is taken care of within the ECM unit itself. This torque can be used as a basis to determine the magnitude of formation tendency. Therefore, the ECMs of the deflection device 750 can be used to determine both the direction as well as the magnitude of the formation tendency.

In order to determine the torque delivered by the ECM, any torque measuring method or mechanism can be employed; however, in this illustrative example, the ECM employs FOC or "vector mode control." FOC is a control feature performed by the motor controller or other processing device for commutation of the motor and which obtains torque as part of its control process. For example, as part of the control feature, such as FOC control, torque can be calculated by the motor controller based on the current input into the stator. Moreover, other methods can be used to determine torque, such as torque sensors placed inside or outside the motor and which measure torque output of the ECM.

Therefore, to implement feedback control, the motor controllers can have the processor, discussed above, connected with memory elements via a system bus, for execution of control instructions, such as FOC. Data related to electrical signals, including voltage and current, can be obtained through a variety of ways including I/O devices for processing by the motor controller. Electrical data, such as current supplied to the stator, can be used by the one or more processors for calculating or determining torque of one or both ECMs.

Determining Formation Tendency Using Shaft Deflection Device

Referring again to FIG. 5, and as discussed above the direction and magnitude of the formation tendency can be determined by rotating a deflected drilling shaft 24 through a substantially 360 degree sweep during which the toolface of the drill bit 22 is pressed against the circumferential periphery of the borehole wall. This sweep can be carried out, for example, by the motor controller 955 of the ECMs communicating an instruction to the ECM motor to rotate the corresponding eccentric rings 156, 158. In the absence of any lateral force, such as formation tendency, the force required to rotate the eccentric rings 156, 158 in one complete revolution will be constant throughout the sweep. However, if the formation imposes a lateral force, the portion of the sweep which acts opposite the formation tendency will require the greatest, or maximum, torque to turn the rings. By measuring this peak maximum torque, as well as the orientation of the drilling shaft 24 or drill bit 22 at which it occurred, the lateral force applied by the formation as well as its direction can be determined.

In order to obtain such a measurement, the eccentric rings can be rotated to sweep the drilling shaft and rotate the toolface direction of the drill bit substantially one complete azimuthal rotation while recording the maximum torque, as well as the orientation of the eccentric rings at which it occurs using the built-in feedback control of the ECM. Initially, the eccentric rings are rotated to set a desired amount of deflection (0 degrees to a maximum amount of deflection, or from "0" to "2e"). The drilling shaft and toolface is then swept/rotated through 360 degrees of the azimuthal direction. This rotation is illustrated, for example, in FIG. 5 with the drill bit 22 rotating in the direction of arrow 15. During this rotation of the toolface, the torque exerted by the motor(s) to rotate the eccentric rings is measured continuously by the feedback process in the motor controller. This provides an indirect measurement of the lateral forces which are exerted on the drilling shaft at the toolface by the formation tendency. Specifically, the torque which is required by the ECM to overcome the lateral forces which resists rotation of the biasing mechanism is used to determine the formation tendency magnitude and direction.

Moreover, for this sweeping action, the toolface is preferably rotated opposite the rotational direction of the drilling shaft during drilling. For example in FIG. 5, the drill bit is swept counterclockwise in the direction of arrow 15, while the housing 46 tends to rotate clockwise. This is due to the "roll" of housing 46 discussed above caused by the spinning of the drilling shaft 24 in the clockwise direction during drilling. By sweeping the toolface in the opposite direction that the drilling shaft 24 rotates to drill, the time required for the drill bit 22 to complete the 360 degree sweep with respect to the housing is reduced. Additionally, the ability of ECM motors and other motors to rotate in both directions (forward and reverse) ensures the capability to sweep the toolface in the opposite direction of the drill string rotation as well.

If directional drilling is underway with the toolface of the drill bit biased against the borehole via deflection of the drilling shaft, and the ECM(s) is controlled to complete a full rotation sweep of the toolface about the borehole via the biasing mechanism, and elevated drag (evidenced as a torque peak at the ECM) is only measured in the drilling direction, then there is no formation force at work on the toolface and no directional correction is required. If, however, a torque peak(s) is detected at another point(s) about the sweep, then formation tendency is present and is acting from the direction(s) in which the toolface is pressing when the torque peak (drag on the toolface) is detected and the magnitude of the formation force acting at that point corresponds to the magnitude of the torque peak at that position in the sweep. In this latter case, the detected formation tendency must be compensated for in order to achieve the desired drilling direction.

During the full rotational sweep of the toolface, experienced torque is measured and averaged. This becomes a baseline against which the torque peaks can be compared and quantified. To understand this, it must be appreciated that the peaks essentially cancel out in the averaging process; that is, each peak of increased torque occurs at the position where the toolface is pressing against the particular force, but there is a commensurate (same magnitude) torque valley at the opposite circumferential position about the borehole where the toolface is pressing in the same direction of the force in the sweep. In this manner, the current relative drilling direction/force and formation direction/force can be resolved and compared to the desired drilling direction/force. The difference is the adjustment that needs to be made to the new drilling direction/force.

These comparisons and corrections are exemplified in the example of FIG. 4. The direction and magnitude of the formation tendency as well as desired drilling direction are provided as variables for calculating a resulting vector. The resulting vector indicates the corrected direction of the toolface to overcome the formation tendency and attain the desired drilling direction. Thereafter, the ECM motors actuate the eccentric rings to sweep the toolface into the corrected direction. In such manner the steering direction can be revised and corrected to achieve drilling requirements.

This correction method can be better understood if analogized to a swimmer crossing a river to reach a particular point on the opposite bank. If the direction and magnitude of the river's current that is taking the swimmer off course can be determined (likened to the formation force), corrective measures can be taken by the swimmer to counter the current (swimming a bit more upstream) and still reach his/her desired destination on the opposite bank.

As stated above, the sweeping rotation of the toolface is preferably made in the opposite direction to the strings rotational direction while drilling (counterclockwise versus clockwise) in order to reduce the time required to complete the 360 degree sweep/rotation. The ability of ECM motors and other motors to rotate in both directions (forward and reverse) ensures the capability to rotate the toolface in the opposite direction of the drill string rotation.

Furthermore, the rotation of the toolface may be performed while drilling is ongoing (i.e., without interrupting drilling). For example, the process can be conducted manually by an operator, or can be carried out automatically with computer processing and software. With automatic implementation, the process can be conducted periodically, repeatedly, or continuously as drilling proceeds. Processing steps can be performed in the motor controller, shared or carried out in another processor such as the surface operator control unit or another control processing unit in the rotary steerable drill.

Figure 12:
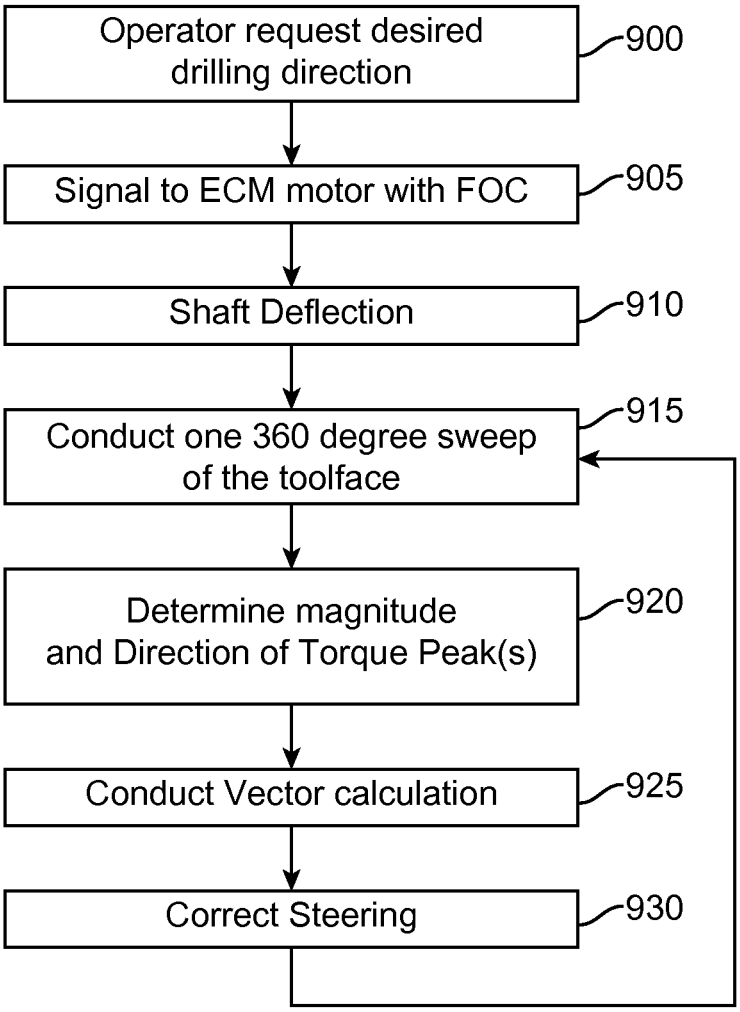
FIG. 12 is a diagrammatic flowchart for correcting the drilling direction based on a detected formation tendency.

A flow diagram of a process for correcting drilling direction is shown in FIG. 12. The initial step 900 includes "Operator request desired drilling direction." This step can involve the operator sending a signal from the surface controller to the rotary steerable drilling unit to drill in a particular desired direction, which can include azimuthal and angle or deflection requests. The step 905 "Signal to ECM motor with FOC" involves the receipt of a signal from the Operator control unit or a communication apparatus in the rotary steerable drill to drill in a particular direction, and/or to rotate the eccentric rings, and/or rotate and deflect the drilling shaft, or similar instruction regarding drilling direction. This can involve the use of one or more, and preferably two ECM in a rotary steerable drilling device that are each connected with a respective eccentric ring and capable of rotating the eccentric rings to achieve a desired deflection and/or rotation of the toolface. Further, the ECMs employ FOC as part of their feedback control in the motor controller, and can calculate or otherwise determine the ECM torque delivery based on electrical signals such as current input into the motor, as described previously.

The next step 910 "Shaft deflection" involves deflecting the drilling shaft to the desired degree of deflection. Accordingly one or both ECM's can actuate the eccentric rings to deflect the drilling shaft the desired degree. In particular, instructions are sent by the respective motor controller to the rotor of each ECM to rotate the particular number of times required to rotate the eccentric rings to a desired position to deflect the drilling shaft to a desired degree of deflection. This step can be optional, as the drilling shaft may already be deflected to a desired degree. The next step 915 is "Conduct one full rotation of the toolface." This step involves the sweeping rotation of the toolface one full azimuthal rotation either in the same rotational direction as the drilling shaft or in the opposite direction of the drilling shaft. Accordingly, the motor controllers of one or both ECM send instructions to rotate the eccentric rings together in order to sweep the drilling shaft and toolface approximately one full 360 degree revolution.

The next step 920 is "Determine magnitude and direction of torque peak(s)". This step occurs in the motor controller of the ECM(s) or other controller. In particular, if one motor is required to carry out determination of the torque delivered by rotation of the ECM, the motor controller records the torque during the full sweep rotation of the toolface, and records the torque peak(s) regarding both direction and magnitude. The torque for example can be calculated by the motor controller based on the electrical signals, such as current supplied to stator or other component(s) of the ECM. Further, the ECM motor controller further records the point in the sweep at which the particular torque peak occurs. Moreover, the average torque of the full rotation is calculated and recorded by the motor controller or other processing unit for comparison to, and quantification of the torque peaks corresponding to current drilling direction and force, as well as direction and magnitude of the formation force/tendency.

Step 925 is "Conduct vector calculation." At this stage, based on the torque information in step 920 and the desired drilling direction from step 900, the vector calculation for overcoming the formation tendency is calculated. The motor controller or other processing unit compares the formation peak torque to the average torque, with the difference giving the magnitude of the formation tendency. Moreover, the motor controller or other processing unit has received or saved in its memory elements the desired drilling direction as requested by the operator in step 900. Based on the direction and magnitude of the formation tendency, as well as desired direction, the motor controller or other processing unit calculates the vector at which the toolface must drill in order to overcome the formation tendency and achieve the desired drilling direction.

Step 930 is "Correct Steering" wherein based on the vector calculation, the direction of drilling is corrected to achieve the desired drilling direction. In particular, the motor controller of one or both ECM units issue instructions to rotate the eccentric rings or drilling shaft in accordance with the calculated vector.

The steps of FIG. 12 can be conducted repetitively, and continuously. As shown, step 930 can proceed back to step 915 to again conduct a full azimuthal sweep. Moreover, the full sweep of step 915 can occur during drilling. In other words, while the drilling shaft and drill bit spin as part of typical drilling action, the drilling shaft and toolface can be continually sweep by the eccentric rings.

While the ECMs are employed in the illustrated in the above discussion, other types of motors can be used, including other types of electric motors, or hydraulic motors, provided that some operating parameter of the motor (such as torque, current or voltage in the case of an electric motor, and pressure or flow rate in the case of a hydraulic motor) can be correlated with the direction at which the drag peaks are experienced during the 360 degree sweep of the toolface.

Further, the determination of the magnitude and direction of the formation tendency can be determined over time in order to plan corrective steering. For example, steps 910 and 920 could be conducted at different points over a time interval, for example t=0, t=1, t=2, t=n . . . With the formation tendency determined at each point, the rate of change in magnitude or direction can be considered over the specific time interval to predict trends in the formation tendency in order to plan for drilling direction over time. For example, if formation tendency is decreasing or increasing, or shifting in direction over the course of time, a controller could calculate the trend and predict or calculate a corrective steering course based on the rate of change in the vector components of the formation tendency.

Moreover, although eccentric rings are discussed above with respect to deflection and rotation of the toolface, other mechanical actuators capable of sweeping/rotating the toolface substantially in a full 360 degrees may be used. For example, a hydraulic motor can be employed which applies force in the longitudinal direction to a sleeve cam having spiral tracks, which cause the toolface to sweep as in step 915. This can be conducted as described above by rotating the sleeve cam such that tracks serve to rotate both rings at the desired deflection. However, in order to determine torque, either pressure or flow rate of the hydraulic motor is used to calculate torque, or torque sensors employed.

Alternatively, complementary ramp actuators 412, 416 as discussed above can be employed (as shown in FIGS. 15*a* and 15*b*). In such cases complementary ramp surfaces 412, 416 engage one another thereby deflecting the drilling shaft. The complementary ramp surfaces 412, 416 can engage to deflect the drilling shaft substantially in the 360 degree sweep as discussed above. This also can be used to conduct the full sweep of the toolface in step 830. However, in order to determine torque, either pressure or flow rate of the hydraulic motor is converted to torque, or torque sensors employed. Alternatively, rather than ramp actuators, pads can be employed containing fluid or solid material which can engage and deflect the drilling shaft. The force for expansion or movement of the pads to engage the drilling shaft can be used for determining the torque during a sweep of the toolface.

Housing and Shaft Sensor Detection

Although, the above examples are discussed with respect to a rotary steerable drilling device, steering corrections as disclosed herein may be used with any type of steering tool which permits substantially 360 degree sweep of the toolface and measurement of the magnitude of the forces. For example, measurement of the magnitude of the formation tendency can be conducted indirectly by use of sensors which detect strains, bending moments or forces which are exerted around the circumference of a component of a steering tool. The measurements, including the direction and magnitude of the lateral force can then be used to adjust the drill in the correct direction to achieve the desired drilling direction.

In one example, the lateral forces experienced at the toolface of a rotary steerable device are determined by measuring the strain or bending moments which are exerted around the circumference of the non-rotating housing of the steerable tool. As previously noted, the rotary steerable device has a substantially non-rotating housing which supports the drive shaft via bearings. Accordingly, sensors can be placed on the housing to detect the deflection of the drilling shaft created from the reaction loads on the bearings. For example, an experienced force during a sweep of the toolface is transmitted along the shaft and to the housing through bearings. Sensors or gauges can be arranged circumferentially around the housing, or on or about the drilling shaft. Sensors detections can be collected periodically or continuously, and used along with the directional data to determine the formation tendency acting on the drill bit during drilling.

Figure 13:
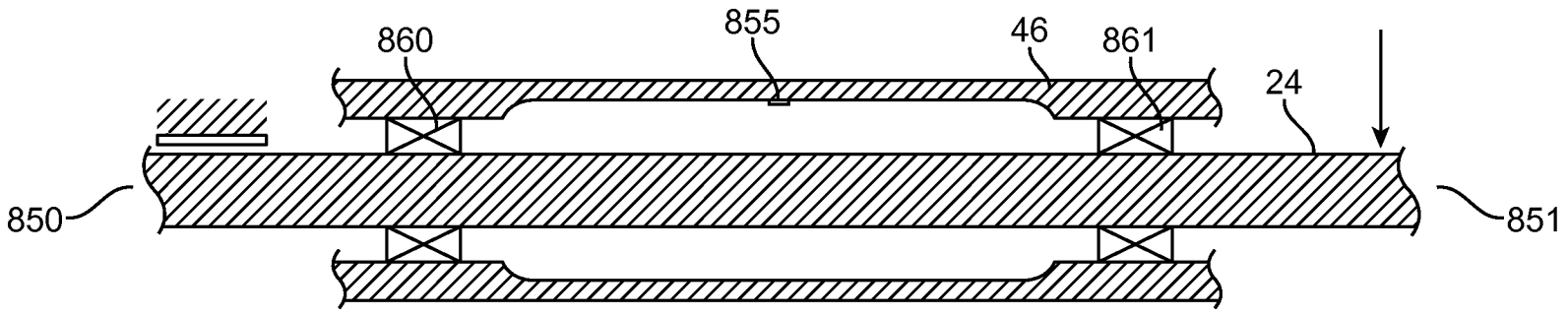
FIG. 13 is a diagram illustrating an exemplary rotary steerable device with sensors for measuring formation tendency.

One example of a rotary steerable device with sensors for measuring lateral forces is illustrated in FIG. 13. Shown therein is a drilling shaft 24 contained in the housing 46 via a set of proximal bearings 860 and distal bearings 861. The drilling shaft 24 is fixed at one end 850 (left side of the figure) while having an applied force at the other end 851 (right side of the figure). One or more sensor(s) 855 are shown in the housing 46 for detecting the degree of deflection of the drilling shaft 24. In reaction to reaction forces applied to the drilling shaft 24, the bearings 860, 861 transfer forces and moments to the housing which the sensor(s) 855 can measure. Alternatively the sensor 855 could be mounted to the drilling shaft and the force and moments measured directly. Measurements to determine forces and moments include direction, strain or some other method that resolves to a magnitude and direction.

When no force is being applied to the drilling shaft, i.e. no deflection is actuated, in which cases the sensors should not detect any force to the drilling shaft. However, for an undeflected drilling shaft, if a force is being detected by the sensors (for example shown by the arrow at end 851 of FIG. 13), then it can be deduced that any detected force is a result of force from the formation tendency applied to the drilling shaft. Therefore, with knowledge of the orientation of the housing, the direction of the measured force can also be determined. The orientation of the housing can be sensed by the housing orientation sensor apparatus 364, which can include resolvers, hall effect sensors, accelerometers or magnet containing sensors. With the magnitude and direction known with respect to the housing, these values can be used to calculate the drilling direction vector to attain the desired drilling direction as discussed with respect to FIGS. 1-4. The sensor data and required information can be provided to a controller or the operator controller for calculating the vector and processing a corrected drilling direction.

Figure 14A:
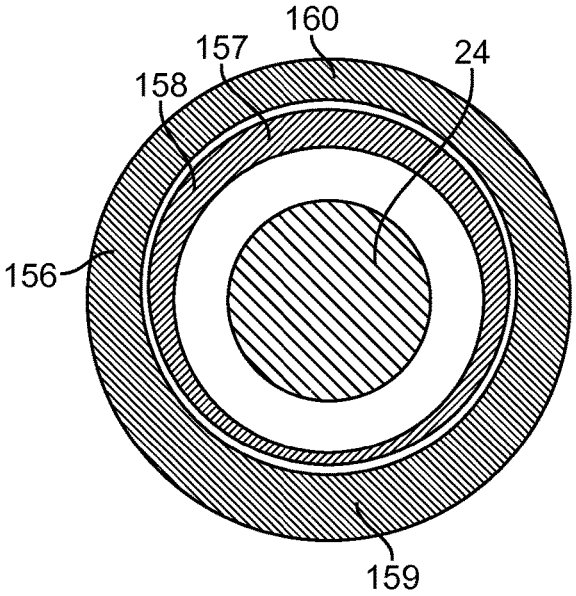
FIG. 14A is a diagram illustrating exemplary eccentric rings configured such that the thick side of the inner ring is oriented with the thin side of the outer ring thereby centering the drilling shaft with respect to the assembly.
Figure 14B:
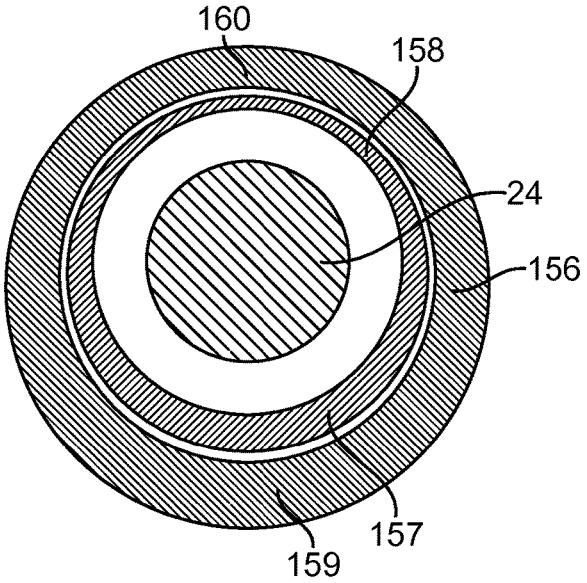
FIG. 14B is a diagram illustrating exemplary eccentric rings configured such that the thick side of the inner ring is oriented with the thick side of the outer ring thereby deflecting the drilling shaft with respect to the assembly.

The deflection of the drilling shaft 24 can be illustrated for example in FIGS. 14A and 14B, which shows nested eccentric rings 156, 158 and drilling shaft 24 nested therein. When the rings are oriented such that the thick side 157 of the inner ring 158 is oriented with the thin side 160 of the outer ring 156 the drilling shaft 24 is centered with respect to the assembly. In this configuration and with no external force on the drilling shaft, the load on the bearings is zero. However, when the thick side 157 of the inner ring 158 is oriented with the thick side 160 of the outer ring, the force is a maximum, and is expected to be whatever force is required to deflect the drilling shaft.

Figure 15A:
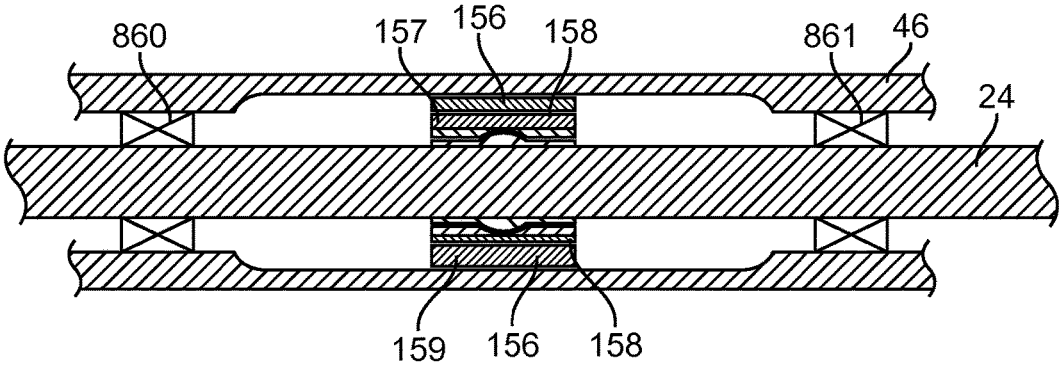
FIG. 15A is a diagram illustrating zero deflection of the drilling shaft with the eccentric rings configured as in FIG. 14A.
Figure 15B:
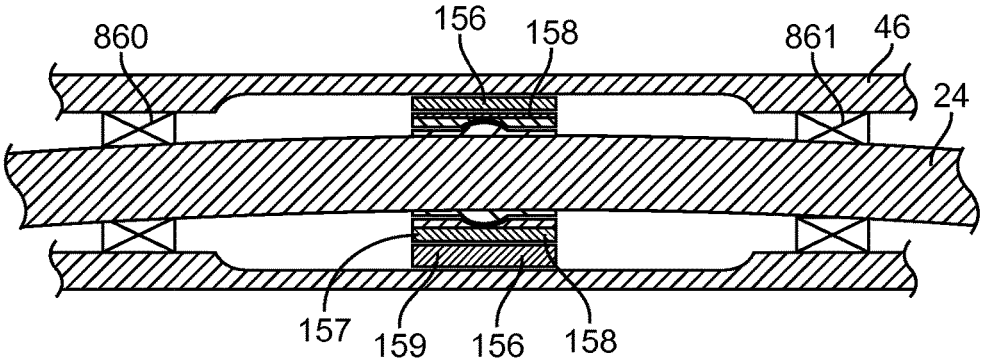
FIG. 15B is a diagram illustrating an exemplary deflected drilling shaft with the eccentric rings configured as in FIG. 14B.

FIGS. 15A and 15B show the eccentric rings 156, 158 configured for zero and maximum deflection of the drilling shaft respectively, corresponding to the positions of the eccentric rings in FIGS. 14A and 14B. When there is no external force applied to the drilling shaft, i.e., zero deflection, then the force to deflect the drilling shaft should be the same in any direction. However, when there is a net force present, the torque required to turn the eccentric rings is offset by the lateral force applied by the formation. The magnitude of the torque is calculated from the load on the eccentric rings and since it is known what it takes to deflect the drilling shaft, the difference must be due to formation tendency. Further, if the magnitude of the force to deflect the drilling shaft in the absence of a lateral force is not known, it can be determined by taking the average of the forces during the azimuthal rotation.

Accordingly, the drilling shaft can be rotated in 360 degree direction, and the force on the drilling shaft measured by either sensor(s) on the housing as transferred via bearings 860, 861 from the drilling shaft, or from sensors directly on the drilling shaft, or other position that detects the force on the drilling shaft. The maximum or peak torque can be taken along with the orientation at which occurred, and the corrected vector calculated in the manner discussed with respect to FIGS. 1-4 for achieving the desired direction.

Figure 16A:
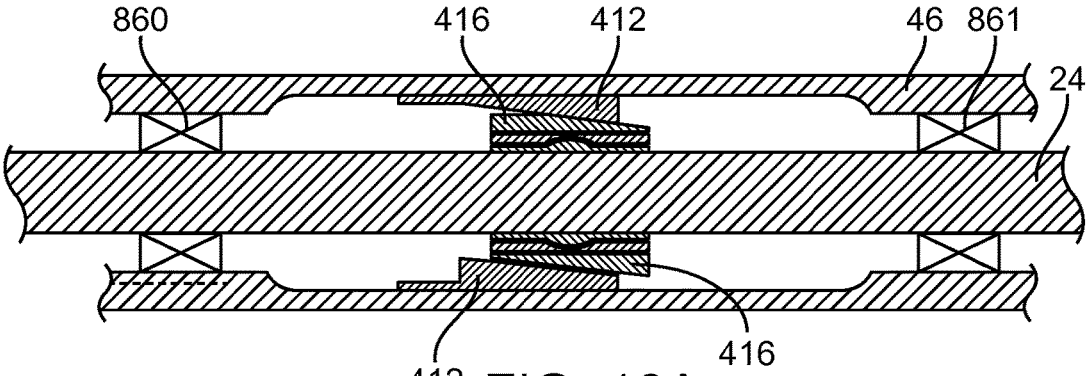
FIG. 16A is an exemplary sectional view illustrating complementary ramps with the housing shifted to the left such that the drilling shaft is in an undeflected configuration.
Figure 16B:
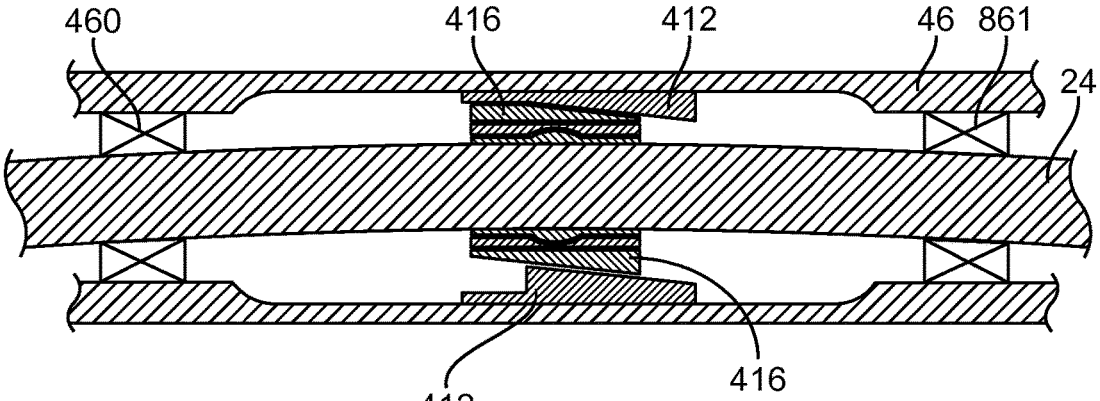
FIG. 16B is an exemplary sectional view illustrating complementary ramps with the housing shifted to the right such that the drilling shaft is in a deflected configuration.

The same concept can be applied to other steering direction setting devices where the mechanical actuator is made up of complementary ramps for deflecting the drilling shaft rather than eccentric rings. For example, FIGS. 16A and 16B show the deflection of a drilling shaft in a housing but using a ramp system instead of eccentric rings. In FIGS. 16A and 16B, there is shown complementary ramps 412, 416 which are shifted against one another to deflect the drilling shaft. For example, by shifting ramps 412 in FIG. 16A to the right, the drilling shaft 24 deflects as shown in FIG. 16B. Therefore, from FIG. 16A to FIG. 16B, the ramps are moved to the right side, i.e. the distal direction toward the drill bit end of the drilling string, thereby deflecting the drilling shaft 24. Not shown in FIGS. 16A and 16B are two additional set of ramps at 90 degrees between ramps 412 and 416, permitting bi-axial deflection. This enables the deflection of the drilling shaft, and thus the tool face as well, in a 360 degree rotation. The force exerted on the bearings is directly proportional to the drilling shaft deflection plus external sources such as formation tendency, similar to the eccentric rings. The force or pressure required to move the ramps is an indication of the resulting load vector.

Accordingly, the ramps can be actuated to deflect the drilling shaft and rotate the toolface through 360 degrees of rotation and record the orientation where the force to move the ramps is greatest. This is an indication of the formation tendency and magnitude. Again vector addition can be used to determine the corrected tool direction.

Push-the-bit Formation Tendency Detection

Figure 17A:
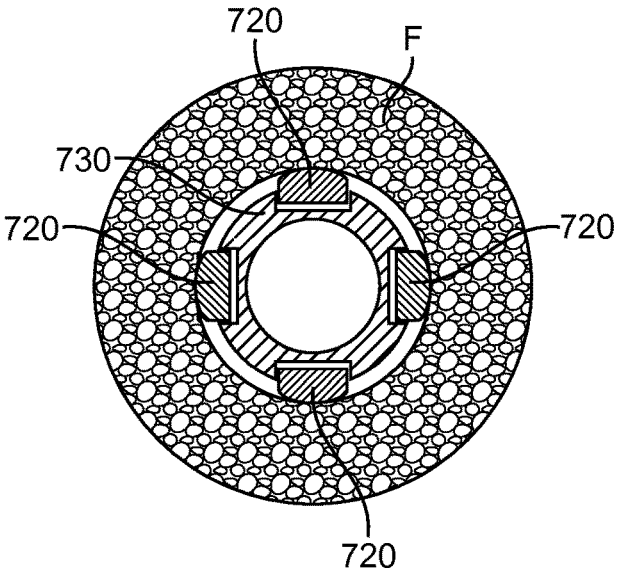
FIG. 17A is an exemplary sectional view illustrating a "push-the-bit" system wherein the hydraulic pads extend uniformly within the borehole.
Figure 17B:
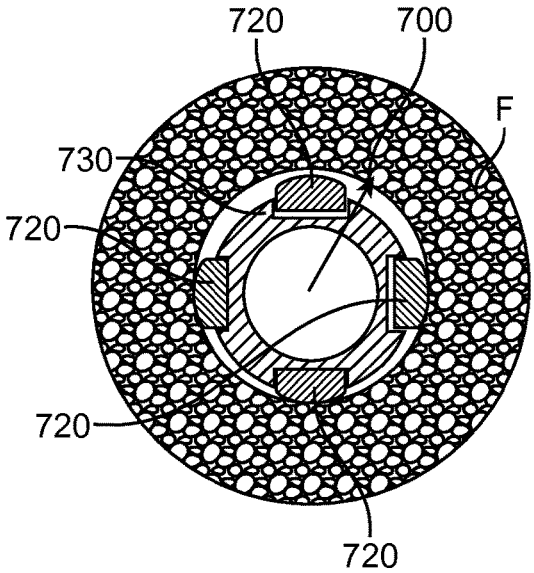
FIG. 17B is an exemplary sectional view illustrating a "push-the-bit" system wherein the hydraulic pads extend non-uniformly within the borehole.

A similar principle can also extend to other tools or other steering direction setting devices. For example, rather than eccentric rings or ramps deflecting a drilling shaft, a steering direction setting device and/or a stabilizer can include four sets of hydraulically expandable pads can be equally spaced around the circumference of housing. Fewer or a greater number of pads may be spaced about the housing, from 3, 4, 5, 6, 7, or 8 or more sets. One simplified example of a "push-the-bit" assembly is illustrated in FIGS. 17A and 17B, where there is shown hydraulic pads 720 coupled to a housing 730, and which inflate to push against the formation F. FIG. 17A shows the pads 720 extended concentrically in the formation F. In such a configuration, there is no lateral force imposed by the formation and therefore the pads 720 extend until they contact the formation F. However, to the extent a formation tendency exists, the assembly is pushed off center thereby resulting in eccentric configuration. For example shown in FIG. 17B, the assembly is eccentric with respect to the formation F, which imposes a formation tendency 700.

Figure 18:
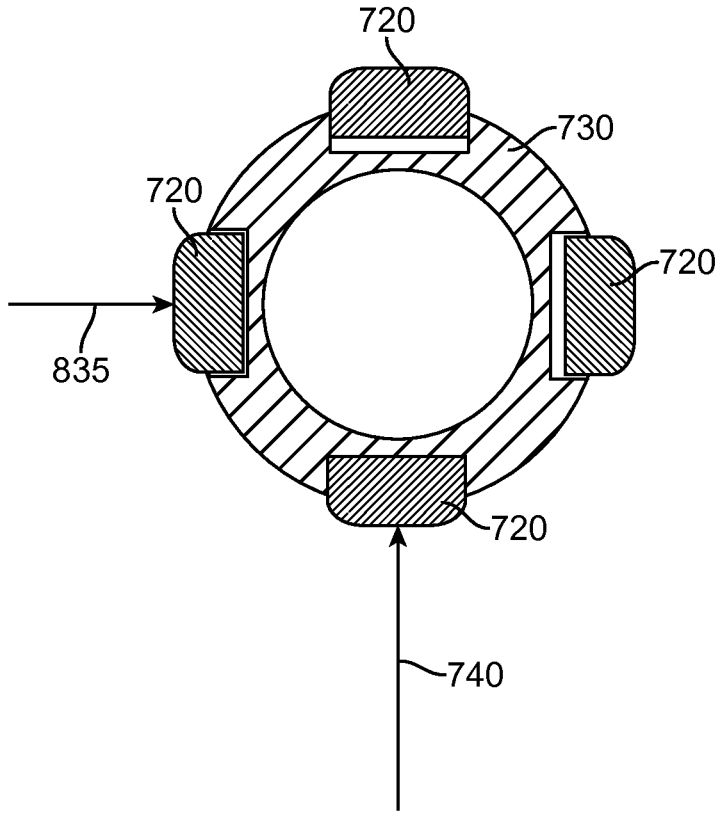
FIG. 18 an exemplary sectional view illustrating component forces of a formation force acting on hydraulic pads of a "push-the-bit" system.
Figure 19:
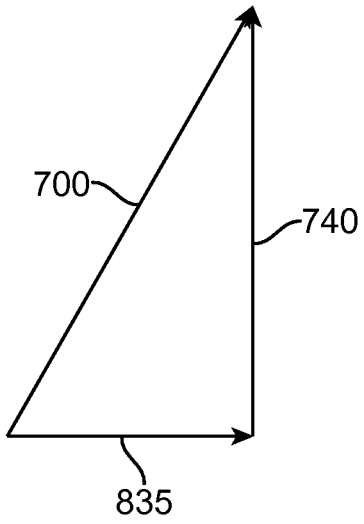
FIG. 19 a schematic view illustrating vector calculation in view of the forces acting on the hydraulic pads of a "push-the-bit" system in FIG. 16.

Any formation tendency exerts a force on one or two pads. Accordingly, a formation tendency as shown in FIG. 17B would impose a force represented by arrows 835 and 740 on two lower left pads of FIG. 18. Further, when an external force pushes the assembly off center, the fluid pressure in the pads retracting increases by the amount proportional to the force applied. Pressure sensors can be placed around the pads or the housing 730 to detect the pressure change. The pressure change can be provided to a controller which calculates the force imposed by the formation tendency based on the pressure on the pads 720, as shown in FIG. 19. Further, the controller can calculate the vector based on the force and calculate the corrected toolface direction to achieve the desired drilling direction as discussed with respect to FIGS. 1-4. The controller can be within the push-the-bit" tool or can be an operator controller on the surface.

Application to other Motors

In other examples, any type of steerable system or motor can be employed according to the disclosure herein. In particular, any system or motor where torque or the direction and magnitude of the formation tendency can be determined can be employed, and used as a basis for vector addition to calculate a corrected direction and implement the new direction. For example, what is known as a "mud motor" can be employed in the drilling operation and is well known in the art. Mud motors comprise a drill pump at the surface which pumps a pressurized drilling fluid through the drill string, also referred to as "mud." Toward the end of the drill string near the drill bit is a stator and rotor contained within the drill string. The pressurized drilling fluid rotates the rotor within the stator thereby causing a drilling shaft and drill bit at the distal end to rotate. A universal joint can connect the drilling shaft and drill bit to the drill string and to facilitate directional drilling. Various steering tools can be applied to toward the end of the drill string or drilling shaft to point the drill bit toolface. Such tools include for example a bent housing which can be employed to orient the direction of drilling. As discussed above, a motor can be applied to sweep the toolface of the drill bit in a 360 degree sweep to measure the force and direction of the formation tendency. These values can then be used to calculate the drilling direction vector to achieve a desired drilling direction.

Accordingly, numerous types of motors or drilling systems can be employed to measure the magnitude and direction of the formation tendency and thereby use such information as basis to calculate a new drilling direction.

Controllers

The one or more ECM(s) employed for control of the deflection device 750 include a motor controller or controller for implementing control of the motor. Each ECM can have a local motor controller and/or there can be a global controller which directly controls the components of both motors or interfaces with the local ECM motor controllers and accordingly receives and sends data and instructions to and from either local units. The global controller can be within the rotary steerable device 20 and interact with the surface operator controller, or the surface operator controller can be the global controller or a series of controllers on the surface and drill string. The controllers alone or together implement instructions for rotation of the motor rotor which communicate with the eccentric rings or other mechanical actuator for deflection and rotation of the shaft.

The controllers implementing the processes according to the present disclosure can include hardware, firmware and/or software, and can take any of a variety of form factors. In particular, such control units herein can include at least one processor optionally coupled directly or indirectly to memory elements through a system bus, as well as program code for executing and carrying out processes described herein. A "processor" as used herein is an electronic circuit that can make determinations based upon inputs. A processor can include a microprocessor, a microcontroller, and a central processing unit, among others. While a single processor can be used, the present disclosure can be implemented over a plurality of processors. For example, the plurality of processors can include the local motor controllers of the ECMs, a global controller and/or the surface operator controller, or a single controller can be employed. Accordingly, for purposes of this disclosure when referring to a motor controller, this includes the local motor controller of one or both ECM or any other controller or plurality of controllers on the surface, in the drill string or rotary steerable drill. Moreover, the controllers can also include circuits configured for performing the processes disclosed herein.

The memory elements can be a computer-usable or computer-readable medium for storing program code for use by or in connection with one or more computers or processors. The medium can be an electronic, magnetic, optical, electromagnetic, infrared, or semiconductor system (or apparatus or device) or a propagation medium (though propagation mediums in and of themselves as signal carriers are not included in the definition of physical computer-readable medium). Examples of a physical computer-readable medium include a semiconductor or solid state memory, magnetic tape, a removable computer diskette, a random access memory (RAM), a read-only memory (ROM), a rigid magnetic disk and an optical disk. The program code can be software, which includes but is not limited to firmware, resident software, microcode, a Field Programmable Gate Array (FPGA) or Application-Specific Integrated Circuit (ASIC) and the like. Implementation can take the forms of hardware, software or both hardware and software elements. Moreover, the controllers can be communicatively connected, including for example input and output devices coupled either directly or through intervening I/O controllers, or otherwise including connections to the stator, rotor, sensors, displays, communication devices, or other components of the rotary steerable unit or drilling shaft deflection device to receive signals, and/or data regarding such components.

Drill String and Rotary Steering Device

Figure 20:
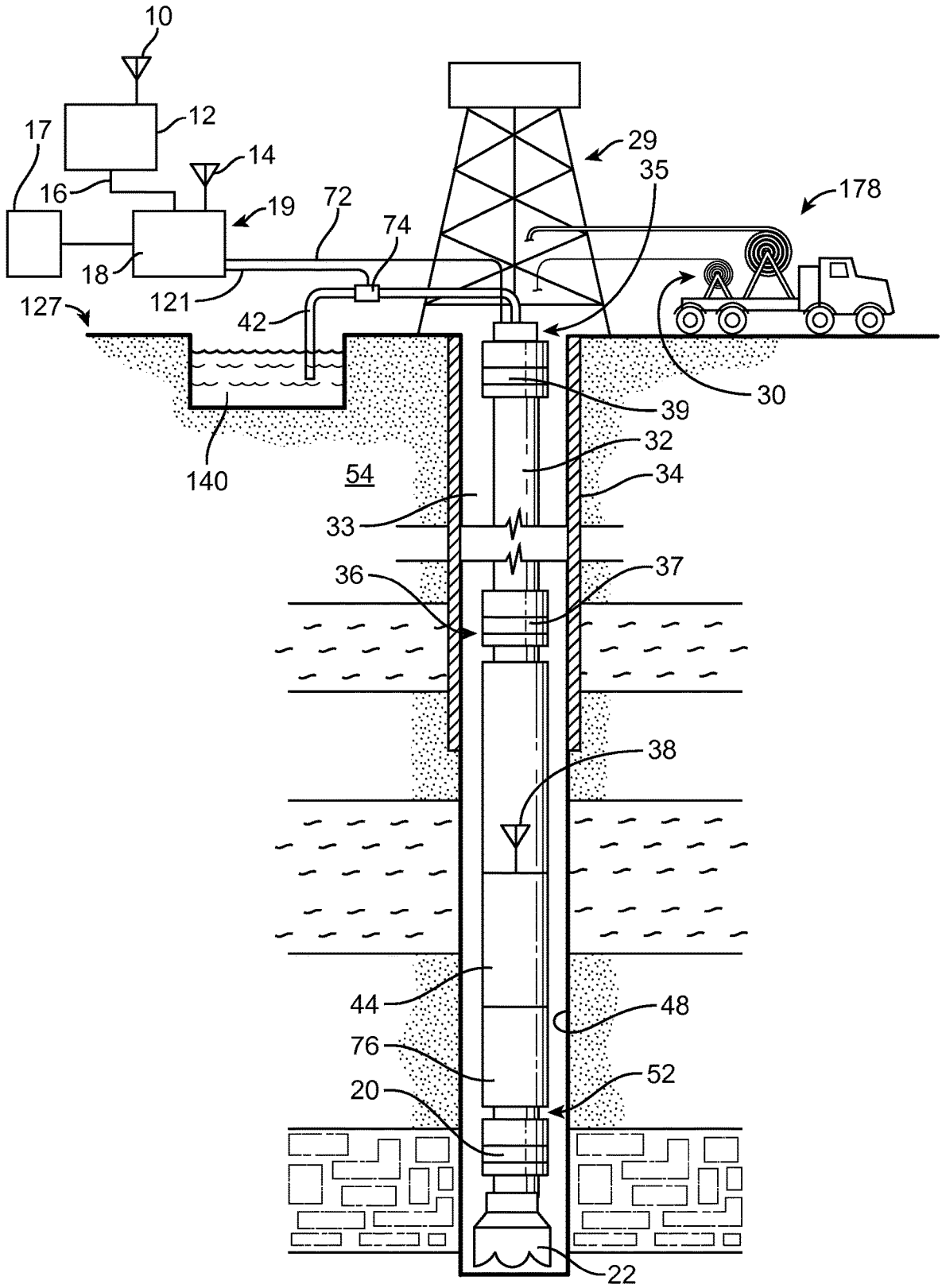
FIG. 20 is a diagram illustrating an embodiment of a drilling rig for drilling a borehole with the drilling system in accordance with the principles of the present disclosure.

The assemblies or tools disclosed herein for determining formation tendency can be employed in a subterranean well environment that is depicted schematically in FIG. 20. A wellbore 48 is shown that has been drilled into the earth 54 from the ground's surface 127 using a drill bit 22. The drill bit 22 is located at the bottom, distal end of the drill string 32 and the bit 22 and drill string 32 are being advanced into the earth 54 by the drilling rig 29. The drilling rig 29 can be supported directly on land as shown or on an intermediate platform if at sea. For illustrative purposes, the top portion of the well bore includes casing 34 that is typically at least partially made up of cement and which defines and stabilizes the wellbore after being drilled.

As shown in FIG. 20, the drill string 32 supports several components along its length. A sensor sub-unit 52 is shown for detecting conditions near the drill bit 22, conditions which can include such properties as formation fluid density, temperature and pressure, and azimuthal orientation of the drill bit 22 or string 32. In the case of directional drilling, measurement while drilling (MWD)/logging while drilling (LWD) procedures are supported both structurally and communicatively. The instance of directional drilling is illustrated in FIG. 20. The lower end portion of the drill string 32 can include a drill collar proximate the drilling bit 22 and a drilling device such as a rotary steerable drilling device 20, or other drilling devices disclosed herein. The drill bit 22 may take the form of a roller cone bit or fixed cutter bit or any other type of bit known in the art. The sensor sub-unit 52 is located in or proximate to the rotary steerable drilling device 20 and advantageously detects the azimuthal orientation of the rotary steerable drilling device 20. Other sensor sub-units 35, 36 are shown within the cased portion of the well which can be enabled to sense nearby characteristics and conditions of the drill string, formation fluid, casing and surrounding formation. Regardless of which conditions or characteristics are sensed, data indicative of those conditions and characteristics is either recorded downhole, for instance at the processor 44 for later download, or communicated to the surface either by wire using repeaters 37, 39 up to surface wire 72, or wirelessly or otherwise. If wirelessly, the downhole transceiver (antenna) 38 can be utilized to send data to a local processor 18, via topside transceiver (antenna) 14. There the data may be either processed or further transmitted along to a remote processor 12 via wire 16 or wirelessly via antennae 14 and 10.

Coiled tubing 178 and wireline 30 can be deployed as an independent service upon removal of the drill string 32. The possibility of an additional mode of communication is contemplated using drilling mud 40 that is pumped via conduit 42 to a downhole mud motor 76. The drilling mud is circulated down through the drill string 32 and up the annulus 33 around the drill string 32 to cool the drill bit 22 and remove cuttings from the wellbore 48. For purposes of communication, resistance to the incoming flow of mud can be modulated downhole to send backpressure pulses up to the surface for detection at sensor 74, and from which representative data is sent along communication channel 21 (wired or wirelessly) to one or more processors 18, 12 for recordation and/or processing.

The sensor sub-unit 52 is located along the drill string 32 above the drill bit 22. The sensor sub-unit 36 is shown in FIG. 20 positioned above the mud motor 76 that rotates the drill bit 22. Additional sensor sub-units 35, 36 can be included as desired in the drill string 32. The sub-unit 52 positioned below the motor 76 communicates with the sub-unit 36 in order to relay information to the surface 127.

A surface installation 19 is shown that sends and receives data to and from the well. The surface installation 19 can exemplarily include a local processor 18 that can optionally communicate with one or more remote processors 12, 17 by wire 16 or wirelessly using transceivers 10, 14.

The exemplary rotary steerable drilling device 20 schematically shown in FIG. 20 can also be referred to as a drilling direction control device or system. As shown, the rotary drilling device 20 is positioned on the drill string 32 with drill bit 22. However, one of skill in the art will recognize that the positioning of the rotary steerable drilling device 20 on the drill string 22 and relative to other components on the drill string 22 may be modified while remaining within the scope of the present disclosure.

Numerous examples are provided herein to enhance understanding of the present disclosure. A specific set of examples are provided as follows. In a first example a method is disclosed for causing a desired drilling direction of a steerable subterranean drill in consideration of a contemporaneously detected formation tendency force acting on a drill bit of the steerable subterranean drill, the method including detecting, utilizing a steering direction setting device, a direction and magnitude of a formation tendency force acting on the drill bit of the steerable subterranean drill; and configuring the steering direction setting device contemporaneously to cause the drill bit of the steerable subterranean drill to drill in the desired direction, counteracting the formation tendency force based on the detected direction and magnitude of the formation tendency force acting on the drill bit.

In a second example, the method according to the first example is disclosed, wherein the magnitude of the formation tendency force is detected utilizing one or more sensors on one of (i) a deflection housing and (ii) drilling shaft of the steering direction setting device.

In a third example, the method according to the first or second examples is disclosed, further including detecting the magnitude of the formation tendency force based on the magnitude of forces acting on one of (i) a deflection housing and (ii) drilling shaft of the steering direction setting device.

In a fourth example, the method according to any of the preceding examples first to the third is disclosed, further including detecting the magnitude of the formation tendency force based on the amount of resistance supplied in an electrically commutated motor in the steering direction setting device.

In a fifth example, the method according to any of the preceding examples first to the fourth is disclosed wherein the steerable subterranean drill is a push-the-bit steerable drill, having a plurality of extendable pads spaced circumferentially about an exterior of a housing.

In a sixth example, the method according to any of the preceding examples first to the fifth is disclosed, wherein the steering direction setting device comprises the plurality of extendable pads.

In a seventh example, the method according to any of the preceding examples first to the sixth is disclosed, wherein the magnitude of the formation tendency is detected utilizing at least one of the plurality of extendable pads.

In an eighth example, the method according to any of the preceding examples first to the seventh is disclosed wherein the steering direction setting device includes a drilling shaft deflection device including a drilling shaft rotatably supported in a drilling shaft housing; a drilling shaft deflection assembly comprising an outer eccentric ring and an inner eccentric ring that engages the drilling shaft; and a pair of electrically commutated drive motors anchored relative the housing and respectively coupled, one each, to the inner and outer eccentric rings for rotating each eccentric ring in two directions.

In a ninth example, the method is disclosed according to any of the preceding examples first to the eighth, further including detecting the magnitude of the formation tendency based on torque output in at least one electrically commutated motor of the steering direction setting device.

In a tenth example, the method according to any of the preceding examples first to the ninth is disclosed, wherein torque is determined, at a controller, from the current supplied to the at least one electrically commutated motor of the steering direction setting device.

In an eleventh example, the method according to any of the preceding examples first to the tenth is disclosed, wherein the steerable subterranean drill is a rotary steerable subterranean drill comprising the steering direction setting device which includes a drilling shaft having the drill bit on a distal end thereof, said drilling shaft rotatably supported in a housing, the drilling shaft and the housing being each substantially cylindrical shaped and having a longitudinal centerline, the longitudinal centerlines of the drilling shaft and housing being substantially coincident when the drilling shaft is undeflected within the housing and non-coincident when deflected.

In an twelfth example, the method according to any of the preceding examples first to the eleventh is disclosed, wherein detecting the magnitude of the formation tendency comprises deflecting the drilling shaft so that the drilling shaft extends from a housing at an angle; and rotating the deflected drilling shaft through a substantially 360 degree sweep in which the toolface of the drill bit is pressed against the circumferential periphery of the borehole wall during the sweep and wherein formation tendency is measured with respect to the direction of peak magnitude.

In a thirteenth example, the method according to any of the preceding examples first to the twelfth is disclosed further including the steps determining, at a controller, in dependence upon the detected peak magnitude of the formation force tendency acting on the drill bit, an instruction for a corrected azimuthal direction of the toolface of the drill bit with respect to the housing; and issuing, from the controller, the instruction and thereby configuring the toolface of the drill bit in the corrected azimuthal direction with respect to the housing thereby counteracting the formation tendency force based on the detected direction and magnitude of the formation tendency force acting on the drill bit.

In a fourteenth example, a method is disclosed for detecting a formation tendency force acting on a drill bit of a rotary steerable subterranean drill and contemporaneously reconfiguring a direction of the rotary steerable subterranean drill, the method including deflecting a drilling shaft of a drilling shaft deflection device so that the drilling shaft extends from a deflection housing of the drilling shaft deflection device at an angle; rotating the deflected drilling shaft through a substantially 360 degree sweep in which the toolface of the drill bit is pressed against the circumferential periphery of the borehole wall during the sweep and wherein formation tendency is measured with respect to the direction of peak magnitude; and determining, at a controller, the formation tendency force acting on the drill bit based on the measured peak magnitude.

In a fifteenth example, the method according to the fourteenth example further is disclosed including the steps determining, at a controller, in dependence on the determined formation force tendency acting on the drill bit, an instruction for a corrected azimuthal direction of the toolface of the drill bit with respect to the housing; and issuing, from the controller, the instruction and thereby configuring the toolface of the drill bit in the corrected azimuthal direction with respect to the housing thereby counteracting the formation tendency force based on the detected direction and magnitude of the formation tendency force acting on the drill bit.

In a sixteenth example, a drilling apparatus is disclosed including a steerable subterranean drill having a drill bit and a steering direction setting device; a controller; wherein the controller, in dependence upon a detected peak magnitude of the formation force tendency acting on the drill bit, transmits an instruction configuring the steering direction setting device contemporaneously to cause the drill bit of the steerable subterranean drill to drill in a direction counteracting the formation tendency force based on the detected direction and magnitude of the formation tendency force acting on the drill bit.

In a seventeenth example, a drilling apparatus is disclosed according to the sixteenth example, further including one or more sensors, the one or more sensors being communicatively coupled to one of (i) a deflection housing and (ii) a drilling shaft of the steering direction setting device to detect the magnitude of the formation tendency force.

In an eighteenth example, a drilling apparatus according to the sixteenth or seventeenth examples is disclosed, wherein the steering direction setting device comprises one or more electrically commutated drive motors that detect the magnitude of the formation tendency force based on the amount of current supplied to the one or more electrically commutated motors.

In a nineteenth example, a drilling apparatus according to any of the preceding examples sixteenth to the eighteenth is disclosed, wherein the steering direction setting device comprises a plurality of extendable pads, at least one of the plurality of extendable pads detecting the magnitude of the formation tendency.

In a twentieth example, a drilling apparatus according to any of the preceding examples sixteenth to the eighteenth is disclosed, wherein the steerable subterranean drill is a rotary steerable subterranean drill including the steering direction setting device, the rotary steerable subterranean drill further including a drilling shaft having the drill bit on a distal end thereof, said drilling shaft rotatably supported in a housing, the drilling shaft and the housing being each substantially cylindrical shaped and having a longitudinal centerline, the longitudinal centerlines of the drilling shaft and housing being substantially coincident when the drilling shaft is undeflected within the housing and non-coincident when deflected.

In a twenty first example, a drilling apparatus according to any of the preceding examples sixteenth to the twentieth is disclosed, wherein the drilling shaft deflects to extend at an angle with respect the housing, the drilling shaft being rotatable through a substantially 360 degree sweep, and wherein the drill bit including a toolface that is pressed against a circumferential periphery of a borehole wall during the sweep to measure the magnitude of the formation tendency.

The embodiments shown and described above are only examples. Many details are often found in the art such as the other features of a logging system. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A method comprising:

detecting, utilizing a steering direction setting device, a direction and magnitude of a formation tendency normal force vector acting on a drill bit, the drill bit being at an end of a deflected drilling shaft of a steerable subterranean drill string, the drill string, the drilling shaft and the drill bit having a first rotational direction during drilling, the formation tendency normal force vector being generated by a shape of a plurality of layers making up a formation and resulting from a vertical force vector component and a side force vector component of the plurality of layers, the steering direction setting device comprising a drilling shaft deflection device which comprises an electrically commutated drive motor, and the detecting the magnitude of the formation tendency normal force vector based on the amount of current supplied to the electrically commutated motor in the steering direction setting device;

determining the formation tendency normal force vector based on the steering direction setting device causing a full rotational sweep of the deflected drilling shaft, and determining a peak maximum torque during the full rotational sweep, wherein the peak maximum torque is an elevated torque above an average torque of the full rotational sweep of the drill bit, detected at a point about the full rotational sweep other than the predetermined desired drilling direction vector;

calculating a corrected drilling direction vector sufficient to counteract the formation tendency normal force vector to drill in a predetermined desired drilling direction vector; and configuring the steering direction setting device contemporaneously to cause the drill bit of the steerable subterranean drill to drill in the desired drilling direction based on the corrected drilling direction vector, thereby counteracting the formation tendency normal force vector acting on the drill bit, wherein the full rotational sweep of the deflected shaft by the steering direction setting device is in a direction opposite the first rotational direction.

2. The method of claim 1 wherein the steering direction setting device comprises a drilling shaft deflection device comprising:

a drilling shaft rotatably supported in a drilling shaft housing;

a drilling shaft deflection assembly comprising an outer eccentric ring and an inner eccentric ring that engages the drilling shaft; and a pair of electrically commutated drive motors anchored relative the housing and respectively coupled, one each, to the inner and outer eccentric rings for rotating each eccentric ring in two directions.

3. The method of claim 2, further comprising detecting the magnitude of the formation tendency normal force vector based on torque output in the electrically commutated motor of the steering direction setting device.

4. The method of claim 3, wherein torque is determined, at a controller, from the current supplied to the electrically commutated motor of the steering direction setting device.

5. The method of claim 1, wherein the steerable subterranean drill is a rotary steerable subterranean drill comprising the steering direction setting device, the rotary steerable subterranean drill further comprising:

a drilling shaft having the drill bit on a distal end thereof, said drilling shaft rotatably supported in a housing, the drilling shaft and the housing being each substantially cylindrical shaped and having a longitudinal centerline, the longitudinal centerlines of the drilling shaft and housing being substantially coincident when the drilling shaft is undeflected within the housing and non-coincident when deflected.

6. The method of claim 5, wherein a full a full rotational orbiting sweep comprises rotating the deflected drilling shaft through a substantially 360 degree sweep in which the toolface of the drill bit is pressed against the circumferential periphery of the borehole wall during the sweep and wherein formation tendency vector is measured with respect to the direction of peak magnitude.

7. The method of claim 6 further comprising the steps:

determining, at a controller, in dependence upon the detected peak magnitude of the formation tendency normal force vector acting on the drill bit, an instruction for a corrected azimuthal direction of the toolface of the drill bit with respect to the housing; and issuing, from the controller, the instruction and thereby configuring the toolface of the drill bit in the corrected azimuthal direction with respect to the housing thereby counteracting the formation tendency normal force vector.

8. The method of claim 1, wherein the corrected drilling direction vector is determined by vector addition of the formation tendency normal force vector and the predetermined desired drilling direction vector.

9. A method for detecting a formation tendency force acting on a drill bit of a drill string having a rotary steerable subterranean drill and contemporaneously reconfiguring a direction of the rotary steerable subterranean drill, the method comprising:

deflecting a drilling shaft of a drilling shaft deflection device so that the drilling shaft extends from a deflection housing of the drilling shaft deflection device at an angle, the deflecting being driven by an electrically commutated drive motor;

rotating, by the drilling shaft deflection device, the deflected drilling shaft through a substantially 360 degree sweep in which the toolface of the drill bit is pressed against the circumferential periphery of the borehole wall during the sweep and wherein a formation tendency force vector is determined based on the direction of peak magnitude, an amount of current supplied to the electrically commutated motor, the formation tendency force vector being generated by a shape of a plurality of layers making up a formation and resulting from a vertical force vector component and a side force vector component of the plurality of layers, wherein the drill string, the drilling shaft and the drill bit have a first rotational direction during drilling, and wherein the full rotational sweep of the deflected drilling shaft by the drilling shaft deflection device is in a direction opposite the first rotational direction;

determining the formation tendency normal force vector based on a full rotational sweep of a drill bit and determining a peak maximum torque during the full rotational sweep, wherein the peak maximum torque is an elevated torque above an average torque of the full rotational sweep of the drill bit, detected at a point about the full rotational sweep other than the predetermined desired drilling direction vector;

calculating a corrected drilling direction vector sufficient to counteract the formation tendency normal force vector so as to drill in a predetermined desired drilling direction vector; and configuring the steering direction setting device contemporaneously to cause the drill bit of the steerable subterranean drill to drill in the desired drilling direction based on the corrected drilling direction vector, thereby counteracting the formation tendency normal force acting on the drill bit.

10. The method of claim 9 further comprising the steps:

determining, at the controller, in dependence on the determined formation tendency normal force vector acting on the drill bit, an instruction for a corrected azimuthal direction of the toolface of the drill bit with respect to the housing; and issuing, from the controller, the instruction and thereby configuring the toolface of the drill bit in the corrected azimuthal direction with respect to the housing thereby counteracting the formation tendency normal force vector based on the detected direction and magnitude of the formation tendency force acting on the drill bit.

11. A drilling apparatus comprising:

a drill string having a steerable subterranean drill with a drill bit and a steering direction setting device, the steering direction setting device comprising drilling shaft deflection device which comprises an electrically commutated drive motor, and the detecting the magnitude of the formation tendency normal force vector based on the amount of current supplied to the electrically commutated motor in the steering direction setting device;

a controller;

wherein the controller, in dependence upon a detected peak magnitude of the formation tendency normal force vector acting on the drill bit, the peak magnitude of the formation force determined based on a full rotational sweep of a drill bit, wherein the peak magnitude torque is an elevated torque above an average torque of the full rotational sweep of the drill bit, detected at a point about the full rotational sweep other than a predetermined desired drilling direction vector, wherein the drill string, the drilling shaft and the drill bit having a first rotational direction during drilling, and wherein the full rotational sweep of the deflected drilling shaft by the steering direction setting is in a direction opposite the first rotational direction, calculates a corrected drilling direction vector sufficient to counteract the formation tendency normal force vector so as to drill in a predetermined desired drilling direction vector, and transmits an instruction configuring the steering direction setting device contemporaneously to cause the drill bit of the steerable subterranean drill to drill in a direction counteracting the formation tendency force vector based on the corrected drilling direction vector.

12. The drilling apparatus of claim 11, wherein the steerable subterranean drill is a rotary steerable subterranean drill comprising the steering direction setting device, the rotary steerable subterranean drill further comprising:

a drilling shaft having the drill bit on a distal end thereof, said drilling shaft rotatably supported in a housing, the drilling shaft and the housing being each substantially cylindrical shaped and having a longitudinal centerline, the longitudinal centerlines of the drilling shaft and housing being substantially coincident when the drilling shaft is undeflected within the housing and non-coincident when deflected.

13. The drilling apparatus of claim 12, wherein the drilling shaft deflects to extend at an angle with respect the housing, the drilling shaft being rotatable through a substantially 360 degree sweep, and wherein the drill bit including a toolface that is pressed against a circumferential periphery of a borehole wall during the sweep to measure the magnitude of the formation tendency.

* * * * *